US008768229B2

(12) United States Patent
Takahashi

(10) Patent No.: US 8,768,229 B2
(45) Date of Patent: Jul. 1, 2014

(54) FIXING DEVICE WITH MECHANISM CAPABLE OF MINIMIZING DAMAGE TO TONER IMAGE AND RECORDING MEDIUM AND IMAGE FORMING APPARATUS INCORPORATING SAME

(75) Inventor: Yoshiharu Takahashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 206 days.

(21) Appl. No.: 13/489,931

(22) Filed: Jun. 6, 2012

(65) Prior Publication Data

US 2013/0004213 A1 Jan. 3, 2013

(30) Foreign Application Priority Data

Jun. 30, 2011 (JP) ..... 2011-146127

(51) Int. Cl.
*G03G 15/20* (2006.01)

(52) U.S. Cl.
CPC ..... *G03G 15/2085* (2013.01)
USPC ..... 399/323

(58) Field of Classification Search
CPC ..... G03G 15/2028; G03G 15/2085
USPC ..... 399/322, 323, 405
See application file for complete search history.

(56) References Cited

U.S. PATENT DOCUMENTS

| | | | | |
|---|---|---|---|---|
| 6,205,316 | B1 * | 3/2001 | Iida | 399/323 |
| 8,602,414 | B2 * | 12/2013 | Osaki | 271/311 |
| 2007/0116498 | A1 * | 5/2007 | Nakano et al. | 399/323 |
| 2008/0101827 | A1 * | 5/2008 | Mori | 399/323 |
| 2011/0188874 | A1 | 8/2011 | Takahashi et al. | |
| 2012/0020681 | A1 | 1/2012 | Naitoh et al. | |
| 2012/0045241 | A1 | 2/2012 | Takahashi et al. | |

FOREIGN PATENT DOCUMENTS

| | | |
|---|---|---|
| JP | 7-140831 | 6/1995 |
| JP | 2003-43836 | 2/2003 |
| JP | 2004-61854 | 2/2004 |

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

A fixing device includes at least one separator including a pawl separatably contacting a fixing rotary body to separate a recording medium discharged from a fixing nip formed between the fixing rotary body and a pressing rotary body from the fixing rotary body; at least one first rotary body rotatably supported by the at least one separator to contact and guide the recording medium separated by the pawl in a recording medium conveyance direction; at least one second rotary body disposed downstream from the first rotary body in the recording medium conveyance direction to contact and guide the recording medium guided by the first rotary body in the recording medium conveyance direction; and at least one brush mounted on an outer circumferential surface of at least one of the first rotary body and the second rotary body.

20 Claims, 10 Drawing Sheets

FIG. 14

| | WITH FIBERS | | WITHOUT FIBERS |
|---|---|---|---|
| | ELECTROSTATIC FIBERS | SHEET BRUSH | PFA ROLLER PAIR |
| ELIMINATION OF SCRATCHES AND GLOSSY STREAKS | RANK 4 | RANK 4 | RANK 3 |
| ELIMINATION OF WATER DROPLET MARKS | GOOD | GOOD | FAIR |
| IMPROVEMENT IN DURABILITY | GOOD | FAIR | GOOD |

FIXING DEVICE WITH MECHANISM CAPABLE OF MINIMIZING DAMAGE TO TONER IMAGE AND RECORDING MEDIUM AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-146127, filed on Jun. 30, 2011, in the Japanese Patent Office, the entire disclosure of which is hereby incorporated by reference herein.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device installed in such image forming apparatuses may include a fixing roller and an opposed pressing roller that apply heat and pressure to a recording medium bearing a toner image. For example, the pressing roller is pressed against the fixing roller heated by a heater to form a fixing nip therebetween through which the recording medium bearing the toner image is conveyed. As the fixing roller and the pressing roller rotate and convey the recording medium through the fixing nip, they apply heat and pressure to the recording medium, melting and fixing the toner image on the recording medium.

Thereafter, the recording medium bearing the toner image is discharged from the fixing nip toward the outside of the fixing device. However, the recording medium may adhere to the fixing roller due to an adhesive force of the toner image heated by the fixing roller. To address this circumstance, a separation pawl may be located at an exit of the fixing nip to separate the recording medium from the fixing roller. Since the separation pawl is also designed to contact and guide the recording medium to the outside of the fixing device, the separation pawl has a side effect of producing scratches on the toner image on the recording medium.

To address this problem, a guide roller may be disposed in proximity to the separation pawl to guide the recording medium separated from the fixing roller by the separation pawl toward the outside of the fixing device.

However, immediately after the recording medium is discharged from the fixing nip, the recording medium still stores heat conducted from the fixing roller, softening the toner image thereon. While the recording medium moves from the separation pawl to the guide roller, it comes into contact with the separation pawl and the guide roller. Hence, as the recording medium slides over the separation pawl and the guide roller, the separation pawl and the guide roller may scratch the softened toner image on the recording medium, thus producing scratches and glossy streaks on the toner image.

Additionally, as the recording medium conveyed through the fixing nip is applied with heat and pressure, moisture contained in the recording medium may be evaporated and adhered to an interior wall of a conveyance path through which the recording medium discharged from the fixing nip is conveyed as water droplets. When the water droplets move to the recording medium, they may be left as water droplet marks on the recording medium.

SUMMARY OF THE INVENTION

This specification describes below an improved fixing device. In one exemplary embodiment of the present invention, the fixing device includes a fixing rotary body rotatable in a predetermined direction of rotation and a pressing rotary body rotatably contacting the fixing rotary body to form a fixing nip therebetween through which a recording medium bearing a toner image is conveyed. A heater is disposed opposite at least one of the fixing rotary body and the pressing rotary body to heat the at least one of the fixing rotary body and the pressing rotary body. At least one separator separatably contacts an outer circumferential surface of the fixing rotary body and includes a pawl to contact and separate the recording medium discharged from the fixing nip from the fixing rotary body. At least one first rotary body is rotatably supported by the at least one separator to contact and guide the recording medium separated by the pawl of the at least one separator in a recording medium conveyance direction. At least one second rotary body is disposed downstream from the first rotary body in the recording medium conveyance direction to contact and guide the recording medium guided by the first rotary body in the recording medium conveyance direction. At least one brush is mounted on an outer circumferential surface of at least one of the first rotary body and the second rotary body.

This specification further describes an improved image forming apparatus. In one exemplary embodiment of the present invention, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein:

FIG. 14 is a lookup table showing results of an experiment performed with the fixing device shown in FIG. 7.

DETAILED DESCRIPTION OF THE INVENTION

Figure 1:
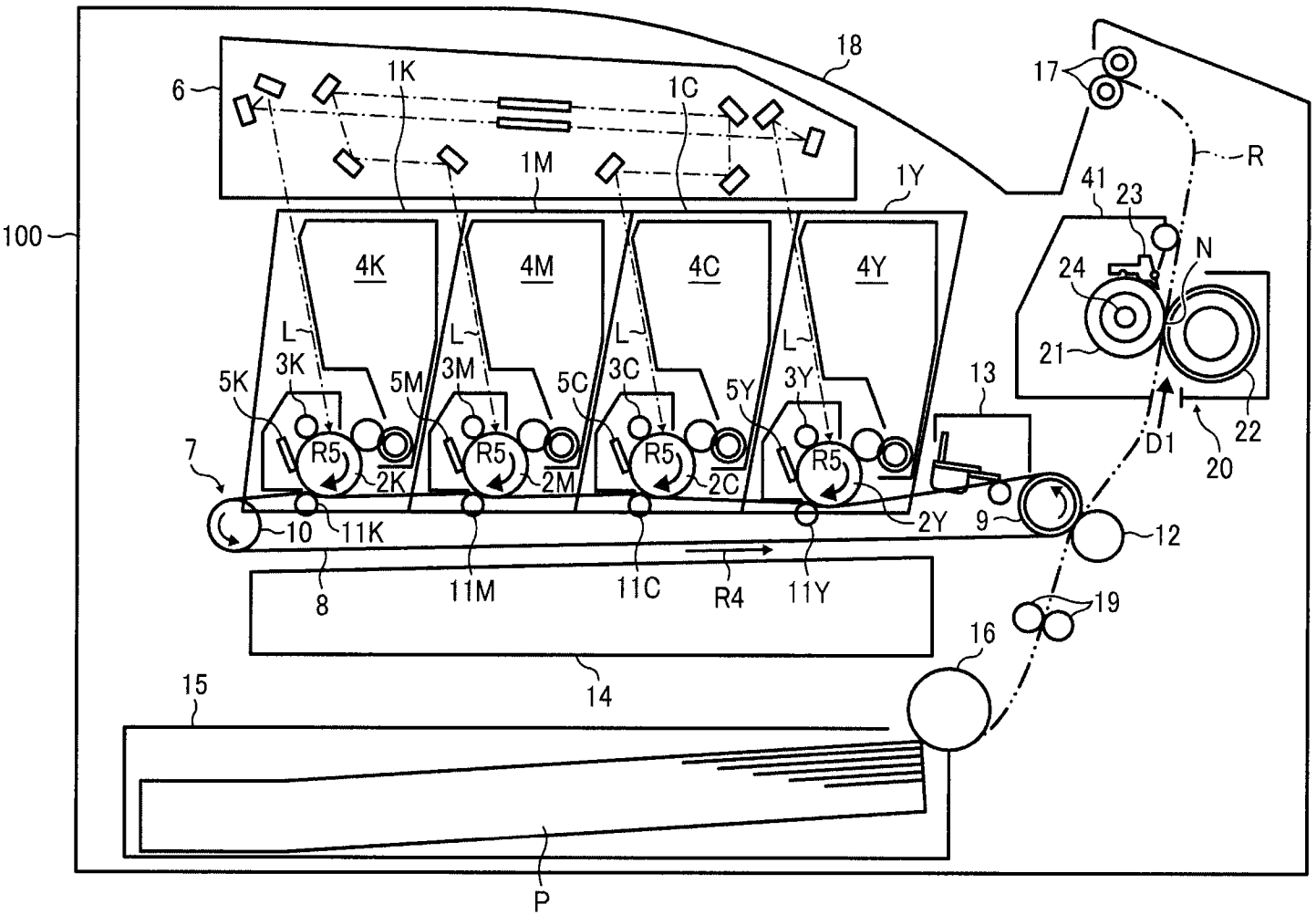
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic vertical sectional view of the image forming apparatus 100. The image forming apparatus 100 may be a copier, a facsimile machine, a printer, a multifunction printer having at least one of copying, printing, scanning, plotter, and facsimile functions, or the like. According to this exemplary embodiment, the image forming apparatus 100 is a printer for forming color and monochrome toner images on a recording medium by electrophotography.

The image forming apparatus 100 includes four process units 1Y, 1C, 1M, and 1K serving as image forming units detachably attached to the image forming apparatus 100, respectively. Although the process units 1Y, 1C, 1M, and 1K contain yellow, cyan, magenta, and black toilers that form yellow, cyan, magenta, and black toner images, respectively, resulting in a color toner image, they have an identical structure. Hence, the following describes the structure of one of them, that is, the process unit 1Y that forms a yellow toner image.

For example, the process unit 1Y includes a drum-shaped photoconductor 2Y serving as an image carrier that carries an electrostatic latent image and a resultant yellow toner image; a charging roller 3Y serving as a charger that charges an outer circumferential surface of the photoconductor 2Y; a development device 4Y serving as a development unit that supplies a developer (e.g., yellow toner) to the electrostatic latent image formed on the outer circumferential surface of the photoconductor 2Y, thus visualizing the electrostatic latent image into a yellow toner image with the yellow toner; and a cleaning blade 5Y serving as a cleaner that cleans the outer circumferential surface of the photoconductor 2Y.

Above the process units 1Y, 1C, 1M, and 1K is an exposure device 6 serving as an exposure unit that emits a laser beam L onto the outer circumferential surface of the respective photoconductors 2Y, 2C, 2M, and 2K to form an electrostatic latent image thereon. For example, the exposure device 6, constructed of a light source, a polygon mirror, an f-θ lens, reflection mirrors, and the like, emits a laser beam L onto the outer circumferential surface of the respective photoconductors 2Y, 2C, 2M, and 2K according to image data sent from an external device such as a client computer.

Below the process units 1Y, 1C, 1M, and 1K is a transfer unit 7 that accommodates an endless intermediate transfer belt 8 serving as a transferor, a driving roller 9, a driven roller 10, four primary transfer rollers 11Y, 11C, 11M, and 11K, a secondary transfer roller 12, and a belt cleaner 13. Specifically, the endless intermediate transfer belt 8 is stretched over the driving roller 9 and the driven roller 10 that support the intermediate transfer belt 8. As the driving roller 9 rotates counterclockwise in FIG. 1, the intermediate transfer belt 8 rotates counterclockwise in FIG. 1 in a rotation direction R4.

Inside a loop formed by the intermediate transfer belt 8 and opposite the four photoconductors 2Y, 2C, 2M, and 2K are the four primary transfer rollers 11Y, 11C, 11M, and 11K serving as primary transferors that transfer the yellow, cyan, magenta, and black toner images formed on the photoconductors 2Y, 2C, 2M, and 2K, respectively, onto an outer circumferential surface of the intermediate transfer belt 8. The primary transfer rollers 11Y, 11C, 11M, and 11K contact an inner circumferential surface of the intermediate transfer belt 8 and press the intermediate transfer belt 8 against the photoconductors 2Y, 2C, 2M, and 2K at opposed positions where the primary transfer rollers 11Y, 11C, 11M, and 11K are disposed opposite the photoconductors 2Y, 2C, 2M, and 2K, respectively, via the intermediate transfer belt 8, thus forming primary transfer nips between the photoconductors 2Y, 2C, 2M, and 2K and the intermediate transfer belt 8 where the yellow, cyan, magenta, and black toner images formed on the photoconductors 2Y, 2C, 2M, and 2K are primarily transferred onto the intermediate transfer belt 8 to form a color toner image thereon. The primary transfer rollers 11Y, 11C, 11M, and 11K are connected to a power supply that applies a predetermined direct current voltage and/or alternating current voltage thereto.

Opposite the driving roller 9 is the secondary transfer roller 12 serving as a secondary transferor that transfers the color toner image formed on the intermediate transfer belt 8 onto a recording medium P. The secondary transfer roller 12 contacts the outer circumferential surface of the intermediate transfer belt 8 and presses the intermediate transfer belt 8 against the driving roller 9, thus forming a secondary transfer nip between the secondary transfer roller 12 and the intermediate transfer belt 8 where the color toner image formed on the intermediate transfer belt 8 is transferred onto the recording medium P. Similar to the primary transfer rollers 11Y, 11C, 11M, and 11K, the secondary transfer roller 12 is connected to a power supply that applies a predetermined direct current voltage and/or alternating current voltage thereto.

The belt cleaner 13, disposed opposite the outer circumferential surface of the intermediate transfer belt 8 and in proximity to the secondary transfer nip, cleans the outer circumferential surface of the intermediate transfer belt 8. Below the intermediate transfer unit 7 is a waste toner container 14 that collects waste toner conveyed from the belt cleaner 13 through a waste toner conveyance tube extending from the belt cleaner 13 to an inlet of the waste toner container 14.

Below the waste toner container 14 in a lower portion of the image forming apparatus 100 is a paper tray 15 that loads a plurality of recording media P (e.g., sheets and OHP (overhead projector) transparencies). The paper tray 15 is attached with a feed roller 16 that feeds a recording medium P from the paper tray 15 toward a registration roller pair 19. In an upper portion of the image forming apparatus 100 are an output roller pair 17 that discharges the recording medium P onto an outside of the image forming apparatus 100 and an output tray 18 that receives and stocks the recording medium P discharged by the output roller pair 17.

The recording medium P fed by the feed roller 16 is conveyed upward through a conveyance path R that extends from the paper tray 15 to the output roller pair 17. The conveyance path R is provided with the registration roller pair 19 disposed below the secondary transfer nip formed between the secondary transfer roller 12 and the intermediate transfer belt 8, that is, upstream from the secondary transfer nip in a recording medium conveyance direction D1. The conveyance path R is further provided with a fixing device 20 disposed above the secondary transfer nip, that is, downstream from the secondary transfer nip in the recording medium conveyance direction D1.

For example, the fixing device 20 includes a fixing roller 21 serving as a fixing rotary body heated by a heater 24; a pressing roller 22 serving as a pressing rotary body that contacts the fixing roller 21 to form a fixing nip N therebetween; a separator 23 that separates the recording medium P from the fixing roller 21; and a fixing exit guide 41 that guides the recording medium P toward the output roller pair 17. According to this exemplary embodiment, a pressing mechanism presses the pressing roller 22 against the fixing roller 21, thus forming the fixing nip N therebetween. However, alternative configurations are possible.

For example, at least one of the fixing rotary body and the pressing rotary body may be an endless belt pressed against another one of the fixing rotary body and the pressing rotary body by a roller or a pad. Further, the pressing rotary body may not press against the fixing rotary body but may merely contact the fixing rotary body. The heater 24 may be a halogen lamp, a resistance heater, or the like. According to this exemplary embodiment, the heater 24 is situated inside the fixing roller 21. Alternatively, the heater 24 may be situated inside the pressing roller 22 or inside each of the fixing roller 21 and the pressing roller 22.

Referring to FIG. 1, the following describes an operation of the image forming apparatus 100 having the structure described above to form a color toner image on a recording medium P.

As a print job starts, a driver drives and rotates the photoconductors 2Y, 2C, 2M, and 2K of the process units 1Y, 1C, 1M, and 1K, respectively, clockwise in FIG. 1 in a rotation direction R5. The charging rollers 3Y, 3C, 3M, and 3K uniformly charge the outer circumferential surface of the respective photoconductors 2Y, 2C, 2M, and 2K at a predetermined polarity. The exposure device 6 emits laser beams L onto the charged outer circumferential surface of the respective photoconductors 2Y, 2C, 2M, and 2K according to yellow, cyan, magenta, and black image data contained in image data sent from the external device, respectively, thus forming electrostatic latent images thereon. The development devices 4Y, 4C, 4M, and 4K supply yellow, cyan, magenta, and black toners to the electrostatic latent images formed on the photoconductors 2Y, 2C, 2M, and 2K, visualizing the electrostatic latent images into yellow, cyan, magenta, and black toner images, respectively.

As the driving roller 9 is driven and rotated counterclockwise in FIG. 1, the driving roller 9 drives and rotates the intermediate transfer belt 8 counterclockwise in FIG. 1 in the rotation direction R4. A power supply applies a constant voltage or a constant current control voltage having a polarity opposite a polarity of toner to the primary transfer rollers 11Y, 11C, 11M, and 11K. Thus, a transfer electric field is created at the primary transfer nips formed between the primary transfer rollers 11Y, 11C, 11M, and 11K and the photoconductors 2Y, 2C, 2M, and 2K, respectively. Accordingly, the yellow, cyan, magenta, and black toner images formed on the photoconductors 2Y, 2C, 2M, and 2K, respectively, are primarily transferred onto the intermediate transfer belt 8 successively by the transfer electric field created at the respective primary transfer nips, in such a manner that the yellow, cyan, magenta, and black toner images are superimposed on a same position on the intermediate transfer belt 8. Consequently, a color toner image is formed on the intermediate transfer belt 8. After the primary transfer of the yellow, cyan, magenta, and black toner images from the photoconductors 2Y, 2C, 2M, and 2K onto the intermediate transfer belt 8, the cleaning blades 5Y, 5C, 5M, and 5K remove residual toner not transferred onto the intermediate transfer belt 8 and therefore remaining on the photoconductors 2Y, 2C, 2M, and 2K therefrom. Then, dischargers discharge the outer circumferential surface of the respective photoconductors 2Y, 2C, 2M, and 2K, initializing the potential thereof so that the respective photoconductors 2Y, 2C, 2M, and 2K are ready for the next print job.

On the other hand, as the print job starts, the feed roller 16 is driven and rotated to feed a recording medium P from the paper tray 15 toward the registration roller pair 19 through the conveyance path R. The registration roller pair 19 feeds the recording medium P to the secondary transfer nip formed between the secondary transfer roller 12 and the intermediate transfer belt 8 at a time when the color toner image formed on the intermediate transfer belt 8 reaches the secondary transfer nip. The secondary transfer roller 12 is applied with a transfer voltage having a polarity opposite a polarity of the charged yellow, cyan, magenta, and black toners of the yellow, cyan, magenta, and black toner images constituting the color toner image formed on the intermediate transfer belt 8, thus creating a transfer electric field at the secondary transfer nip. Accordingly, the yellow, cyan, magenta, and black toner images constituting the color toner image are secondarily transferred from the intermediate transfer belt 8 collectively onto the recording medium P by the transfer electric field created at the secondary transfer nip. The recording medium P bearing the color toner image is conveyed to the fixing device 20 where the fixing roller 21 and the pressing roller 22 apply heat and pressure to the recording medium P, fixing the color toner image on the recording medium P. The separator 23 separates the recording medium P bearing the fixed color toner image from the fixing roller 21. Thereafter, the output roller pair 17 discharges the recording medium P onto the output tray 18. After the secondary transfer of the color toner image from the intermediate transfer belt 8 onto the recording medium P, the belt cleaner 13 removes residual toner not transferred onto the recording medium P and therefore remaining on the intermediate transfer belt 8 therefrom. The removed toner is conveyed and collected into the waste toner container 14.

The above describes the image forming operation of the image forming apparatus 100 to form the color toner image on the recording medium P. Alternatively, the image forming apparatus 100 may form a monochrome toner image by using any one of the four process units 1Y, 1C, 1M, and 1K or may form a bicolor or tricolor toner image by using two or three of the process units 1Y, 1C, 1M, and 1K.

Figure 2:
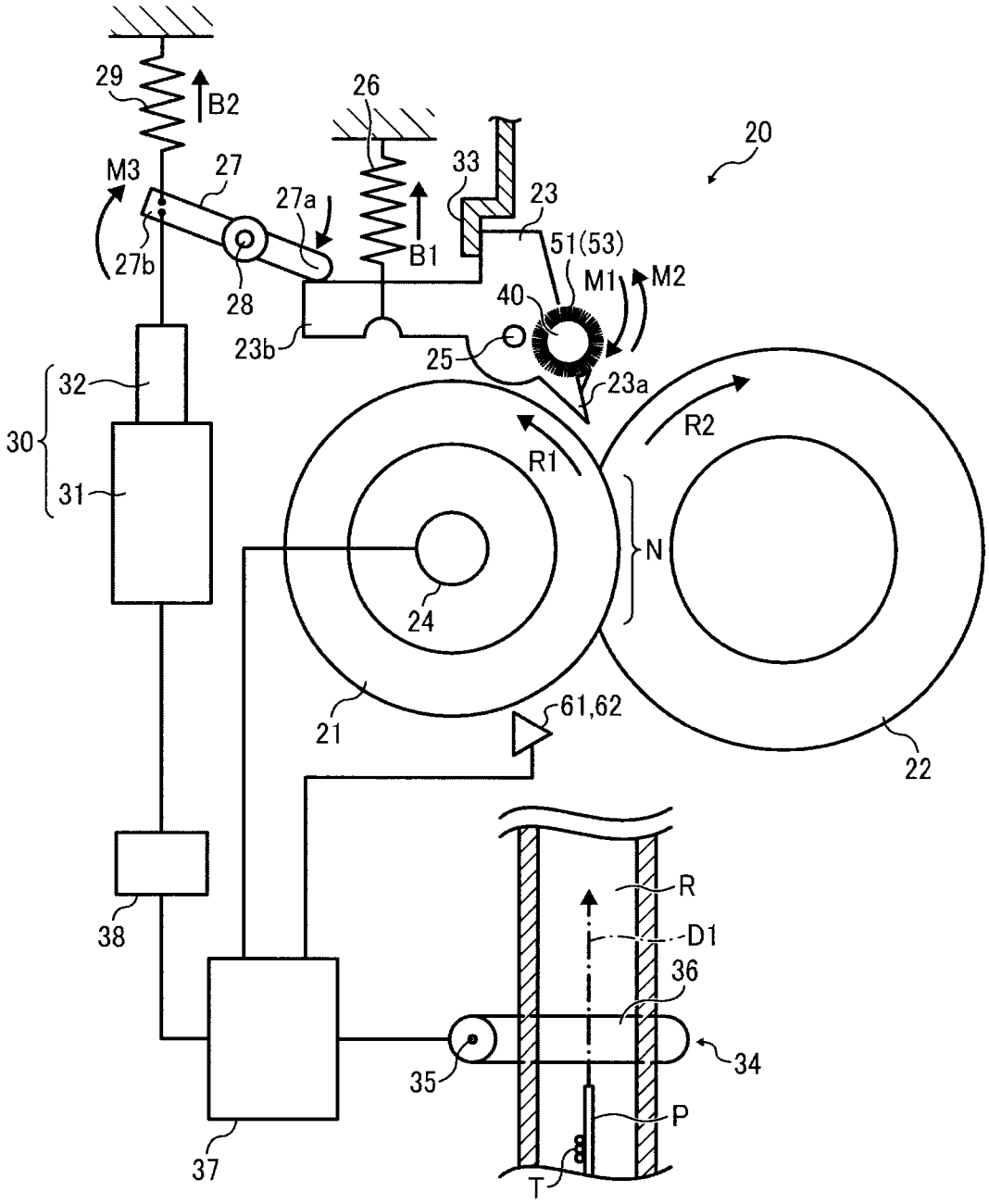
FIG. 2 is a vertical sectional view of a fixing device incorporated in the image forming apparatus shown in FIG. 1 in a state in which no recording medium is conveyed therethrough.
Figure 3:
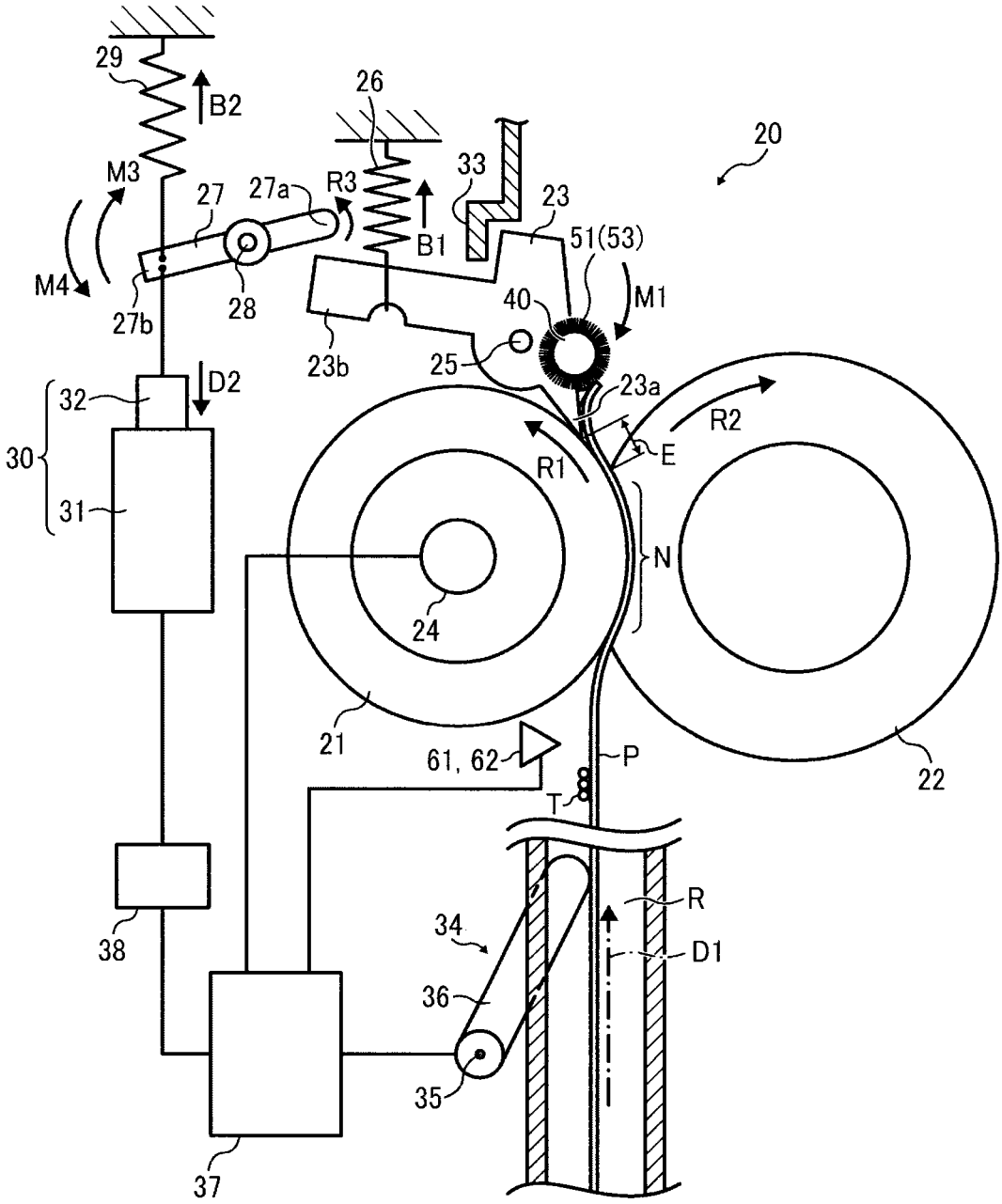
FIG. 3 is a vertical sectional view of the fixing device shown in FIG. 2 in a state in which a recording medium is conveyed therethrough.

Referring to FIGS. 2 and 3, the following describes a construction of the fixing device 20 installed in the image forming apparatus 100 described above.

FIG. 2 is a vertical sectional view of the fixing device 20 in a state in which no recording medium P is conveyed therethrough. FIG. 3 is a vertical sectional view of the fixing device 20 in a state in which a recording medium P is conveyed therethrough. As shown in FIG. 2, the fixing device 20 (e.g., a fuser unit) includes the fixing roller 21 heated by the heater 24 situated inside the fixing roller 21. The fixing roller 21 is rotatable in a rotation direction R1 and the pressing roller 22 is rotatable in a rotation direction R2 counter to the rotation direction R1 of the fixing roller 21. The pressing roller 22 is pressed against the fixing roller 21 to form the fixing nip N therebetween.

As shown in FIG. 3, after the fixing roller 21 is heated by the heater 24 to a predetermined target fixing temperature, as the fixing roller 21 rotating in the rotation direction R1 and the pressing roller 22 rotating in the rotation direction R2 nip and convey a recording medium P bearing a toner image T through the fixing nip N formed between the fixing roller 21 and the pressing roller 22, the fixing roller 21 and the pressing roller 22 apply heat and pressure to the recording medium P, thus melting and fixing the toner image T on the recording medium P.

A thermistor 61 serving as a temperature detector that detects the temperature of the fixing roller 21 is disposed opposite an outer circumferential surface of the fixing roller 21. Similarly, a thermostat 62 preventing overheating of the fixing roller 21 is disposed opposite the outer circumferential surface of the fixing roller 21. A controller 37, that is, a central processing unit (CPU) provided with a random-access memory (RAM) and a read-only memory (ROM), for example, is operatively connected to the heater 24, the thermistor 61, and the thermostat 62. The controller 37 controls the heater 24 based on a detection signal output from the thermistor 61 so as to adjust the temperature of the outer circumferential surface of the fixing roller 21 to a predetermined fixing temperature range.

A detailed description is now given of a construction of the fixing roller 21.

The fixing roller 21 is a tube constructed of a thermal conductive base layer, an elastic layer coating the base layer, and an outer surface layer coasting the elastic layer. The thermal conductive base layer is made of a thermal conductive material having a predetermined mechanical strength, such as carbon steel, aluminum, or the like. The elastic layer is made of synthetic rubber such as silicone rubber, fluoro rubber, or the like. The outer surface layer is made of a heat-resistant, thermal conductive material that facilitates separation of the toner image T on the recording medium P from the fixing roller 21 and enhances the durability of the elastic layer. For example, the outer surface layer may be a fluoroplastic tube made of tetrafluoroethylene-perfluoroalkyl vinyl ether copolymer (PFA), a fluoroplastic coat made of PFA or polytetrafluoroethylene (PTFE), a silicone rubber layer, a fluoro rubber layer, or the like.

A detailed description is now given of a construction of the pressing roller 22.

The pressing roller 22 is a tube constructed of a metal core, an elastic layer coating the metal core, and an outer surface layer coating the elastic layer. For example, the metal core is made of carbon steel tubes for machine structural purposes (STKM). The elastic layer is made of silicone rubber, fluoro rubber, silicone rubber foam, fluoro rubber foam, or the like. The outer surface layer is a heat-resistant fluoroplastic tube made of PFA, PTFE, or the like that facilitates separation of the toner image T on the recording medium P from the pressing roller 22.

A detailed description is now given of a construction of the separator 23.

As shown in FIG. 2, the separator 23 is disposed above the fixing roller 21, that is, downstream from the fixing nip N in the recording medium conveyance direction D1 and opposite the outer circumferential surface of the fixing roller 21. A pawl 23*a* constituting a head of the separator 23 comes into contact with and separates from the outer circumferential surface of the fixing roller 21. The pawl 23*a* has a round front edge that does not damage the fixing roller 21 as it slides over the fixing roller 21. The pawl 23*a* contacts the fixing roller 21 in a direction counter to the rotation direction R1 of the fixing roller 21. The separator 23 is rotatable about a shaft 25, both axial ends of which are rotatably mounted on side plates rotatably mounting both axial ends of the respective fixing roller 21 and the pressing roller 22. As the separator 23 rotates about the shaft 25 clockwise or counterclockwise in FIG. 2, the pawl 23*a* of the separator 23 comes into contact with and separates from the fixing roller 21 independently from other separators 23. FIG. 3 illustrates the pawl 23*a* of the separator 23 brought into contact with the fixing roller 21.

A distance E in a range of from about 5 mm to about 6 mm is provided between an exit of the fixing nip N and a contact position where the pawl 23*a* of the separator 23 contacts the fixing roller 21 in the recording medium conveyance direction D1. The distance E may be as long as possible within a range that does not obstruct separation of the recording medium P from the fixing roller 21 by the pawl 23*a*, increasing time for cooling the recording medium P and minimizing damage inflicted on the toner image T on the recording medium P as the pawl 23*a* contacts and separates the recording medium P from the fixing roller 21.

The separator 23 is made of PFA, polyetherketone (PEK), polyether ether ketone (PEEK), or the like that facilitates separation from and sliding over the fixing roller 21. Alternatively, a surface of the separator 23 may be coated with PFA or Teflon® that facilitates separation from and sliding over the fixing roller 21.

A detailed description is now given of a configuration of a mechanism that moves the separator 23 with respect to the fixing roller 21.

FIGS. 2 and 3 illustrate one example of such mechanism, that is, a contact direction biasing member 26, a separator presser 27, and a separation direction biasing member 29. It is to be noted that since the fixing device 20 includes a plurality of separators 23, a plurality of contact direction biasing members 26 corresponds to the plurality of separators 23. As shown in FIGS. 2 and 3, the contact direction biasing member 26 is anchored to a base 23*b* of the separator 23 constituting one end of the separator 23 in a longitudinal direction thereof disposed opposite the pawl 23*a* constituting another end of the separator 23 in the longitudinal direction thereof. According to this exemplary embodiment, a tension coil spring is used as the contact direction biasing member 26. Alternatively, other biasing members may be used as the contact direction biasing member 26 in view of location and manufacturing costs of the contact direction biasing member 26. The contact direction biasing member 26 biases the separator 23 against the fixing roller 21, thus bringing the separator 23 into contact with the outer circumferential surface of the fixing roller 21.

On the other hand, the separator presser 27 separatably contacts the base 23*b* of the separator 23 to separate the separator 23 from the fixing roller 21. The separator presser 27 is supported by a shaft 28 in such a manner that the separator presser 27 is rotatable about the shaft 28. As the separator presser 27 rotates about the shaft 28 clockwise and counterclockwise in FIG. 2, a free end 27*a* of the separator presser 27 disposed opposite the base 23*b* of the separator 23 comes into contact with and separates from the base 23*b* of the separator 23. The separator presser 27 extends in a direction parallel to an axial direction of the fixing roller 21, thus separatably contacting all of the plurality of separators 23 aligned in the axial direction of the fixing roller 21.

The separator presser 27 is made of lightweight resin having predetermined mechanical strength, heat resistance, and abrasion resistance, such as poly p-phenylene sulfide (PPS), polyphenylene sulfide (PPS), or polyetherketone (PEK). According to this exemplary embodiment, the shaft 28 made of SUS stainless steel is separately manufactured from the separator presser 27 to prevent bending of the separator presser 27 in a longitudinal direction thereof parallel to the axial direction of the fixing roller 21. Alternatively, the separator presser 27 may be made of other materials according to the size of the fixing device 20 and a resilient bias exerted to the separator 23 by the contact direction biasing member 26 and the separation direction biasing member 29.

The separation direction biasing member 29 is anchored to a linkage drivably connected to the separator presser 27 and exerts a resilient bias to the separator presser 27 that separates the separator 23 from the fixing roller 21. FIGS. 2 and 3 schematically illustrate the separation direction biasing member 29 anchored to a base 27*b* of the separator presser 27. As shown in FIG. 2, as the separation direction biasing member 29 pulls the base 27*b* of the separator presser 27 in a direction B2, the free end 27*a* of the separator presser 27 is brought into contact with the base 23*b* of the separator 23. Alternatively, other biasing members may be used as the separation direction biasing member 29 in view of location and manufacturing costs. The contact direction biasing member 26 constantly exerts a resilient bias to the separator 23 that brings the separator 23 into contact with the fixing roller 21. Conversely, the separation direction biasing member 29 exerts a resilient bias to the separator 23 via the separator presser 27 as needed that separates the separator 23 from the fixing roller 21.

A solenoid 30 is connected to the separator presser 27 and serves as a driver that drives the separator presser 27. For example, the solenoid 30 is constructed of a body 31 incorporating a coil and a plunger 32 that protrudes from and retracts into the coil. The plunger 32 is connected to the linkage drivably connected to the separator presser 27. FIGS. 2 and 3 schematically illustrate the plunger 32 connected to the base 27*b* of the separator presser 27. As the coil incorporated in the body 31 is excited and the plunger 32 is refracted into the body 31, the plunger 32 pulls down the base 27*b* of the separator presser 27, thus driving and rotating the separator presser 27 in a rotation direction R3 as shown in FIG. 3.

Above the separator 23 in FIG. 2 is a detent 33 that contacts and halts the separator 23 at a predetermined halting position where the separator 23 is isolated from the fixing roller 21 with a predetermined interval therebetween. Accordingly, even if the separation direction biasing member 29 constantly pulls the base 27*b* of the separator presser 27 in the direction B2 and therefore the separator presser 27 presses against the base 23*b* of the separator 23 against the resilient bias exerted by the contact direction biasing member 26, thus separating the separator 23 from the fixing roller 21, the detent 33 halts the separator 23 at the predetermined halting position with an appropriate interval between the pawl 23*a* of the separator 23 and the outer circumferential surface of the fixing roller 21 regardless of variation in dimension and assembly of parts constituting the separator 23.

A recording medium detector 34 is located upstream from the fixing nip N in the recording medium conveyance direction D1 and detects a recording medium P conveyed toward the fixing nip N. The recording medium detector 34 is constructed of a shaft 35 and a feeler 36 swingably or rotatably supported by the shaft 35. As shown in FIG. 2, before the recording medium P touches the feeler 36, the feeler 36 intersects the conveyance path R. As the recording medium P conveyed through the conveyance path R comes into contact with and abuts the feeler 36, the feeler 36 detects the recording medium P and swings or rotates counterclockwise in FIG. 2 to a position shown in FIG. 3 where the feeler 36 retracts from the conveyance path R, allowing the recording medium P to move to the fixing nip N. After the recording medium P passes through the recording medium detector 34, the feeler 36 returns to a default position shown in FIG. 2 by its own weight or a bias exerted by a biasing member (e.g., a torsion coil spring). Specifically, the feeler 36 comes into contact with and is halted by a detent at the default position shown in FIG. 2.

For example, the feeler 36 is located at a position in proximity to a center of the conveyance path R in a width direction thereof orthogonal to the recording medium conveyance direction D1, thus preventing the recording medium P from being skewed by contact with the feeler 36. Such location of the feeler 36 facilitates smooth conveyance of the recording medium P that prevents creasing of the recording medium P and warping of a toner image T on the recording medium P, enhancing reliability in conveyance of the recording medium P.

According to this exemplary embodiment, the recording medium detector 34 is a contact detector that detects the recording medium P by contacting it. Alternatively, a non-contact detector, such as a reflection optical sensor or a transmission optical sensor, which detects the recording medium P without contacting it may be used. The non-contact detector provides an advantage of precluding skew of the recording medium P because it does not contact the recording medium P.

Further, a jam detector for detecting a jammed recording medium P may be located upstream from the fixing nip N in the recording medium conveyance direction D1. In this case, such jam detector may also serve as the recording medium detector 34. Accordingly, a separate detector that detects the recording medium P is unnecessary, downsizing the fixing device 20 and reducing manufacturing costs.

The solenoid 30 is driven based on a detection signal output from the recording medium detector 34. For example, the solenoid 30 is electrically connected to the recording medium detector 34 via a driving circuit 38 and the controller 37. The controller 37 is the CPU incorporating an input-output (I/O) port. When the recording medium detector 34 detects the recording medium P conveyed toward the fixing nip N and generates a detection signal, the controller 37 drives the solenoid 30 via the driving circuit 38 based on the detection signal sent from the recording medium detector 34.

A detailed description is now given of an operation of the above-described mechanism that moves the separator 23 with respect to the fixing roller 21.

FIG. 2 illustrates a non-contact state in which the separator 23 is isolated from the fixing roller 21 before the recording medium P reaches the recording medium detector 34. Since the recording medium detector 34 does not yet detect the recording medium P, the controller 37 does not drive the solenoid 30. Hence, the solenoid 30 does not drive the separator presser 27. Conversely, the separation direction biasing member 29 exerts a resilient bias to the separator presser 27 that pulls the base 27*b* of the separator presser 27 upward in FIG. 2 toward the separation direction biasing member 29, applying a rotation moment M3 clockwise in FIG. 2 to the separator presser 27. Accordingly, the rotation moment M3 causes the free end 27*a* of the separator presser 27 to press down the base 23*b* of the separator 23.

The separator presser 27 pressing down the base 23*b* of the separator 23 applies a rotation moment M2 counterclockwise in FIG. 2 to the separator 23. Simultaneously, the contact direction biasing member 26 pulls the base 23*b* of the separator 23 upward in FIG. 2 in a direction B1, applying a rotation moment M1 clockwise in FIG. 2 to the separator 23. That is, the separator 23 receives the two forces in the opposite directions: the clockwise rotation moment M1 and the counterclockwise rotation moment M2 counter to the rotation moment M1. However, the rotation moment M2 applied by the separation direction biasing member 29 is greater than the rotation moment M1 applied by the contact direction biasing member 26. Accordingly, the pawl 23*a* of the separator 23 separates from the fixing roller 21. Before the recording medium P is conveyed through the fixing nip N, the pawl 23*a* of the separator 23 is isolated from the fixing roller 21, minimizing wear of the fixing roller 21 due to contact with the pawl 23*a* and therefore allowing the fixing roller 21 to apply heat and pressure to the recording medium P bearing the toner image T for an extended period of time for formation of a high quality toner image. Further, the separator 23 moved by the separation direction biasing member 29 is halted by the detent 33 at the predetermined halting position where the separator 23 is isolated from the fixing roller 21 with the predetermined interval therebetween.

As shown in FIG. 3, when the recording medium P conveyed toward the fixing nip N comes into contact with the feeler 36 of the recording medium detector 34, the controller 37 drives the solenoid 30 via the driving circuit 38 based on a detection signal sent from the recording medium detector 34. Specifically, when a predetermined electric current is supplied to the solenoid 30, the plunger 32 is retracted into the body 31 in a direction D2 against a resilient bias exerted by the separation direction biasing member 29. The plunger 32 pulls down the base 27*b* of the separator presser 27, rotating the free end 27*a* of the separator presser 27 counterclockwise in FIG. 3 in the rotation direction R3. Accordingly, the free end 27*a* of the separator presser 27 separates from the base 23*b* of the separator 23 and thus the separator presser 27 no longer presses down the separator 23.

As the separator presser 27 is isolated from the separator 23, the separator 23 receives only the rotation moment M1 applied by the contact direction biasing member 26. Accordingly, the separator 23 rotates clockwise in FIG. 3, bringing the pawl 23*a* into contact with the fixing roller 21.

Referring to FIGS. 4 to 7, a detailed description is now given of a construction of the fixing exit guide 41 incorporated in the fixing device 20.

Figure 4:
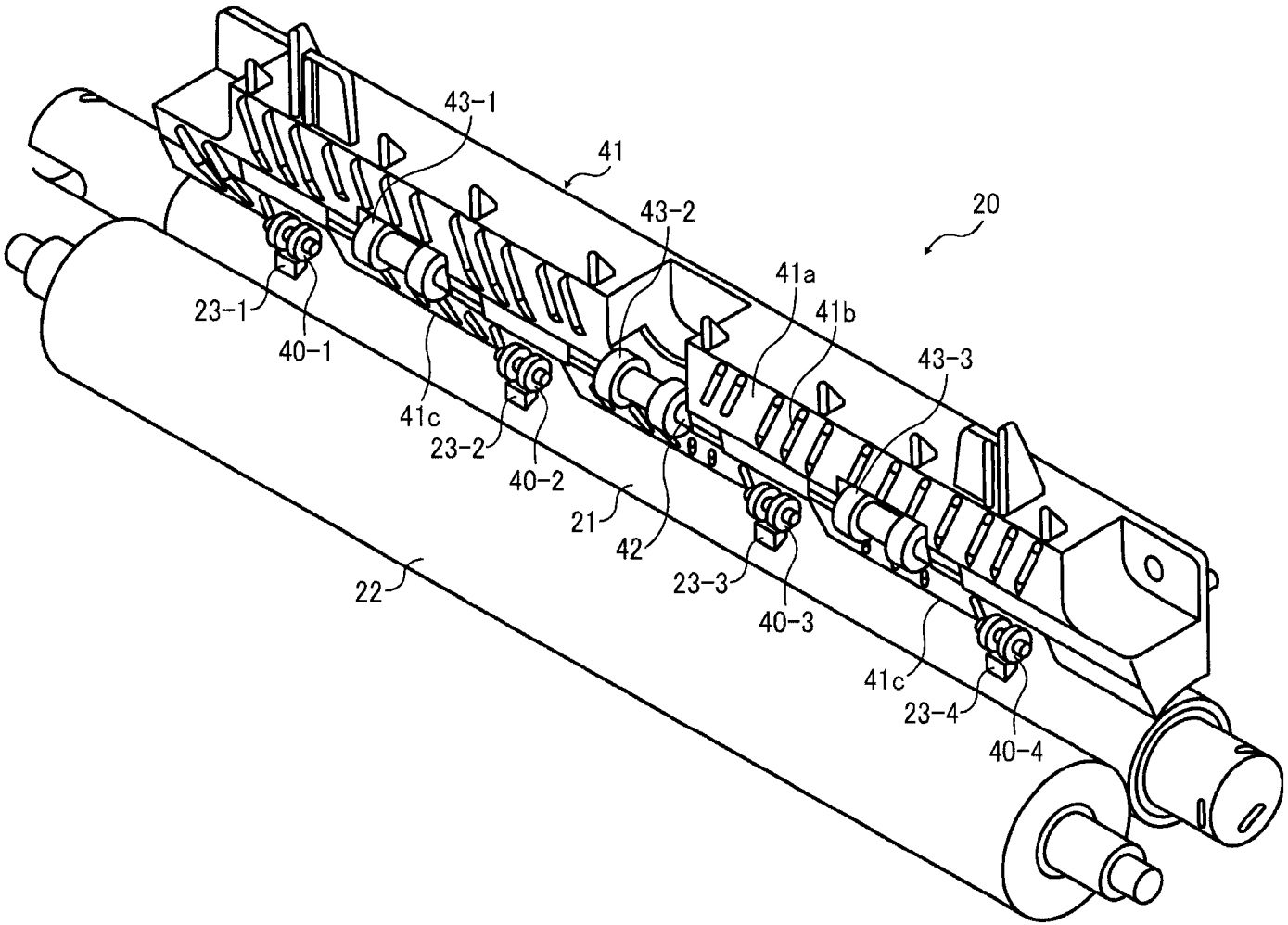
FIG. 4 is a perspective view of the fixing device shown in FIG. 2.
Figure 5:
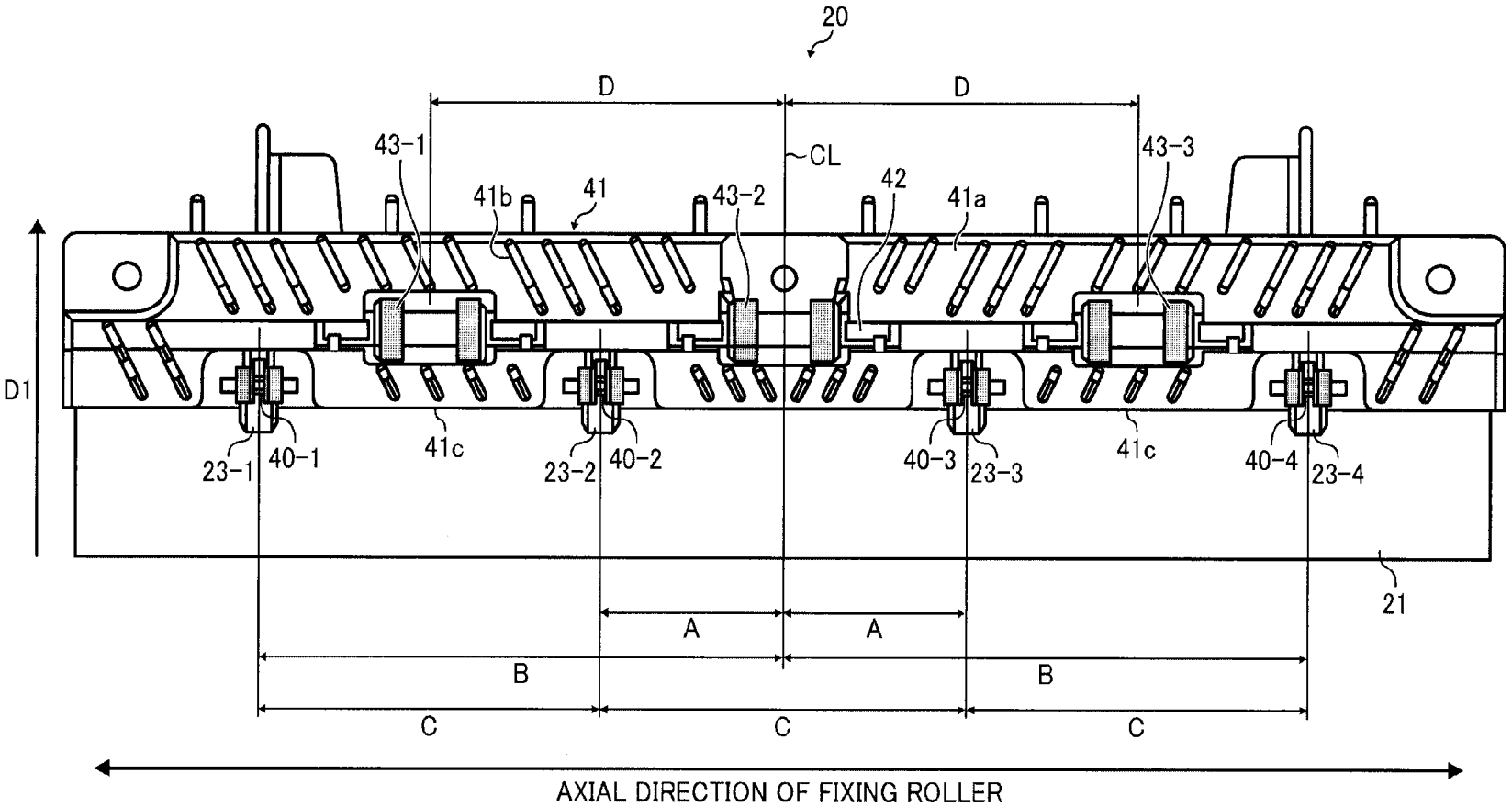
FIG. 5 is a horizontal front view of the fixing device shown in FIG. 4.
Figure 6:
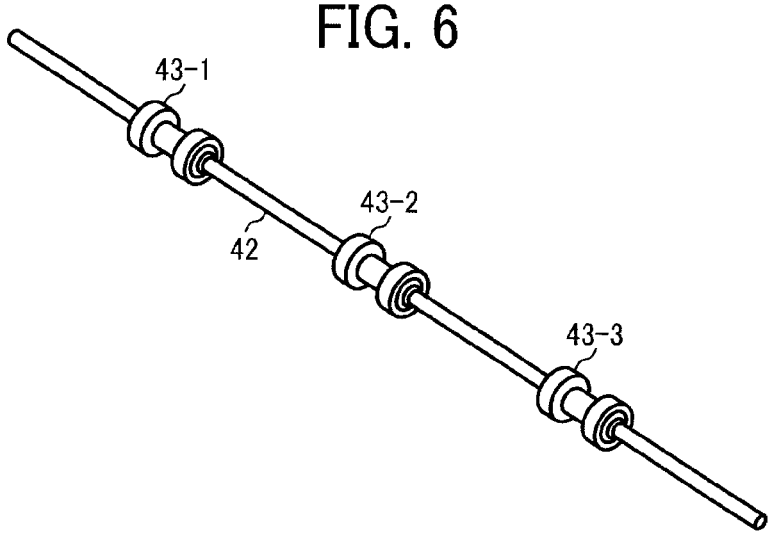
FIG. 6 is a perspective view of guide roller pairs incorporated in the fixing device shown in FIG. 5.
Figure 7:
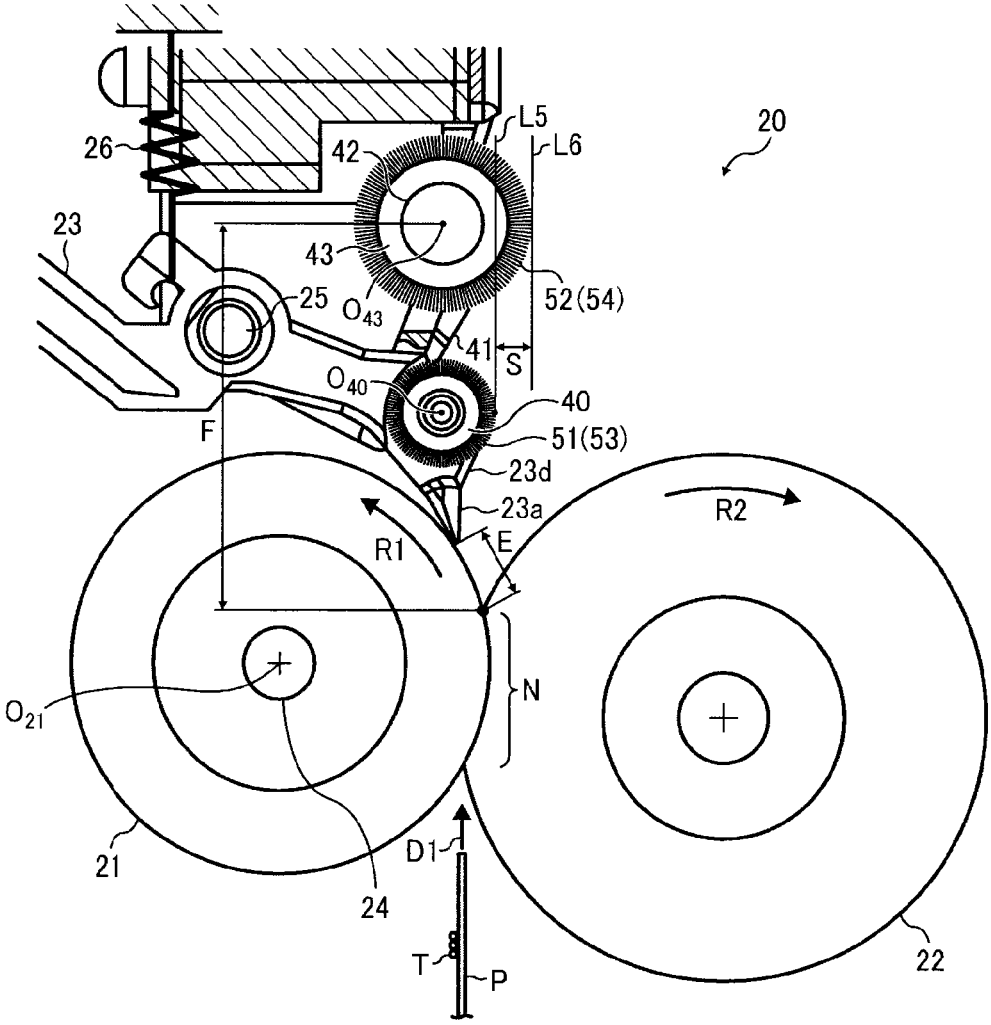
FIG. 7 is a partially enlarged vertical sectional view of the fixing device shown in FIG. 4.

FIG. 4 is a perspective view of the fixing exit guide 41, the fixing roller 21, and the pressing roller 22. FIG. 5 is a horizontal front view of the fixing exit guide 41 and the fixing roller 21. FIG. 6 is a perspective view of guide roller pairs 43-1, 43-2, and 43-3 and a guide roller shaft 42. FIG. 7 is a vertical sectional view of the fixing device 20 illustrating the fixing exit guide 41. As shown in FIG. 7, the fixing exit guide 41 is located above the fixing roller 21, that is, downstream from the fixing nip N in the recording medium conveyance direction D1.

The lightweight fixing exit guide 41 has a heat resistance great enough to endure radiant heat from the fixing roller 21 and is made of a material readily molded into a complex shape such as polyethylene terephthalate (PET) containing glass fiber. As shown in FIG. 4, the fixing exit guide 41 is constructed of a substantially vertical guide face 41*a* constituting a front face of the fixing exit guide 41 that guides the recording medium P discharged from the fixing nip N. A plurality of slanted ribs 41*b* is mounted on the guide face 41*a* that guides the recording medium P. The slanted ribs 41*b* facilitate contact of the recording medium P therewith, shortening the time for which the recording medium P contacts the slanted ribs 41*b*. A lower edge, that is, an upstream edge 41*c* in the recording medium conveyance direction D1, of the guide face 41*a* of the fixing exit guide 41 is located beside pawl roller pairs 40-1, 40-2, 40-3, and 40-4 serving as a first rotary body and aligned with the pawl roller pairs 40-1, 40-2, 40-3, and 40-4 in an axial direction thereof. A predetermined interval is provided between the upstream edge 41*c* of the guide face 41*a* and the outer circumferential surface of the fixing roller 21, preventing the upstream edge 41*c* of the guide face 41*a* from coming into contact with and damaging the fixing roller 21 and jamming the recording medium P between the upstream edge 41*c* of the guide face 41*a* and the fixing roller 21.

The three guide roller pairs 43-1, 43-2, and 43-3 serving as a second rotary body mounting brushes described below rotatably protrude from the guide face 41*a* of the fixing exit guide 41. Each of the guide roller pairs 43-1, 43-2, and 43-3 is constructed of a base made of a heat-resistant material such as polybutylene terephthalate (PBT). As shown in FIGS. 5 and 6, the three guide roller pairs 43-1, 43-2, and 43-3 are evenly spaced on the guide roller shaft 42 with an interval D between the adjacent guide roller pairs 43-1 and 43-2 and the adjacent guide roller pairs 43-2 and 43-3 in a longitudinal direction of the guide roller shaft 42. Hence, six rollers constitute the three guide roller pairs 43-1, 43-2, and 43-3. However, the number of the rollers constituting the guide roller pairs may be changed as needed. The guide roller shaft 42 may be attached to the fixing exit guide 41 with a single motion.

Below the guide roller pairs 43-1, 43-2, and 43-3 are the rotatable four pawl roller pairs 40-1, 40-2, 40-3, and 40-4, serving as a first rotary body mounting brushes 51 and 53 depicted in FIG. 7, protruding from the fixing exit guide 41. Each of the pawl roller pairs 40-1, 40-2, 40-3, and 40-4 is constructed of a base made of a heat-resistant material such as PBT. As shown in FIG. 5, each of the pawl roller pairs 40-1, 40-2, 40-3, and 40-4 is constructed of two rollers sandwiching the pawl 23*a* depicted in FIG. 2 of respective separators 23-1, 23-2, 23-3, and 23-4 collectively illustrated in FIG. 2 as the separator 23 that separates the recording medium P from the fixing roller 21. As shown in FIG. 4, according to this exemplary embodiment, eight rollers constitute the four pawl roller pairs 40-1, 40-2, 40-3, and 40-4. However, the number of the rollers used as the pawl roller pairs may be changed as needed.

As shown in FIG. 5, the four separators 23-1, 23-2, 23-3, and 23-4 collectively illustrated in FIG. 2 as the separator 23 are aligned in the axial direction of the fixing roller 21. For example, the four separators 23-1, 23-2, 23-3, and 23-4 are evenly or substantially evenly spaced in such a manner that the two separators 23-1 and 23-2 located in the left half in FIG. 5 and the two separators 23-3 and 23-4 located in the right half in FIG. 5 are symmetric with respect to a center line CL of a recording medium conveyance region in the axial direction of the fixing roller 21. Specifically, an interval A is provided between the center line CL and the respective inboard separators 23-2 and 23-3 in the axial direction of the fixing roller 21; an interval B greater than the interval A is provided between the center line CL and the respective outboard separators 23-1 and 23-4 in the axial direction of the fixing roller 21. A substantially identical interval C is provided between the separators 23-1 and 23-2, between the separators 23-2 and 23-3, and between the separators 23-3 and 23-4.

As shown in FIG. 5, the two separators 23-1 and 23-2 located in the left half in FIG. 5 and the two separators 23-3 and 23-4 located in the right half in FIG. 5 are symmetric with respect to the center line CL, maintaining the symmetrical shape of the recording medium P discharged from the fixing nip N and thereby preventing dog-ear or folded corner and jamming of the recording medium P for smooth conveyance of the recording medium P. The substantially evenly spaced, four separators 23-1, 23-2, 23-3, and 23-4 cause the pawls 23*a* to exert a uniform force to the recording medium P throughout a width direction thereof parallel to the axial direction of the fixing roller 21 to separate the recording medium P from the fixing roller 21. For example, a particular one of the pawls 23*a* of the separators 23-1, 23-2, 23-3, and 23-4 may not damage the fixing roller 21 by exerting a greater force to the fixing roller 21 while the pawls 23*a* contact the fixing roller 21 to separate the recording medium P from the fixing roller 21 as shown in FIG. 3.

As shown in FIG. 5, the three guide roller pairs 43-1, 43-2, and 43-3 are located downstream from the separators 23-1, 23-2, 23-3, and 23-4 in the recording medium conveyance direction D1. The three guide roller pairs 43-1, 43-2, and 43-3 are aligned in the axial direction of the fixing roller 21 in the recording medium conveyance region in such a manner that the interval D is provided between the center guide roller pair 43-2 and each of the ambilateral guide roller pairs 43-1 and 43-3. According to this exemplary embodiment, the interval D is about 58 mm Accordingly, the upstream, four separators 23-1, 23-2, 23-3, and 23-4 and the downstream, three guide roller pairs 43-1, 43-2, and 43-3 create two staggered rows, downsizing the fixing exit guide 41. The four separators 23-1, 23-2, 23-3, and 23-4 and the three guide roller pairs 43-1, 43-2, and 43-3 aligned in the two staggered rows also exert uniform pressure to the recording medium P throughout the width direction thereof, preventing the pawls 23*a* of the separators 23-1, 23-2, 23-3, and 23-4, the pawl roller pairs 40-1, 40-2, 40-3, and 40-4, and the guide roller pairs 43-1, 43-2, and 43-3 from producing scratches and glossy streaks on the toner image T on the recording medium P.

If the guide roller pairs 43-1, 43-2, and 43-3 are located downstream from the pawls 23*a* of the separators 23-1, 23-2, 23-3, and 23-4 in the recording medium conveyance direction D1 in such a manner that the guide roller pairs 43-1, 43-2, and 43-3 and the separators 23-1, 23-2, 23-3, and 23-4 do not create the two staggered rows, it is necessary to prevent the separators 23-1, 23-2, 23-3, and 23-4 and the pawl roller pairs 40-1, 40-2, 40-3, and 40-4 from touching or striking the guide roller pairs 43-1, 43-2, and 43-3. For example, if the guide roller pairs 43-1, 43-2, and 43-3 and the pawl roller pairs 40-1, 40-2, 40-3, and 40-4 have a greater diameter, a greater interval is needed between the guide roller pairs 43-1, 43-2, and 43-3 and the pawl roller pairs 40-1, 40-2, 40-3, and 40-4 in the recording medium conveyance direction D1, obstructing downsizing of the fixing exit guide 41. To address this problem, the guide roller pairs 43-1, 43-2, and 43-3 and the pawl roller pairs 40-1, 40-2, 40-3, and 40-4 create the two staggered rows.

Figure 8:
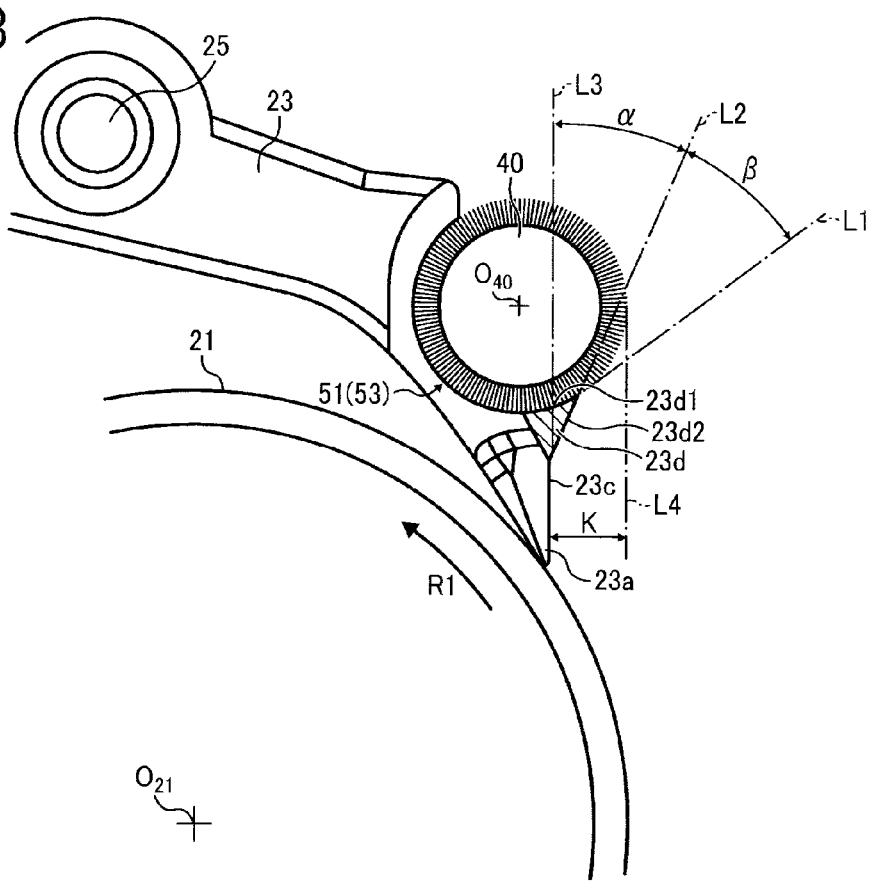
FIG. 8 is a partial vertical sectional view of a separator, a pawl roller pair, and a fixing roller incorporated in the fixing device shown in FIG. 7.

Referring to FIG. 8, a detailed description is now given of a construction of a pawl roller pair 40 representing the pawl roller pairs 40-1, 40-2, 40-3, and 40-4 depicted in FIG. 5.

FIG. 8 is a partial vertical sectional view of the pawl roller pair 40, the separator 23, and the fixing roller 21. The pawl roller pair 40 is disposed in proximity to the pawl 23*a* of the separator 23. An axis $O_{40}$ of the pawl roller pair 40 extends in parallel with an axis $O_{21}$ of the fixing roller 21. As shown in FIG. 8, the axis $O_{40}$ of the pawl roller pair 40 is inboard from or on the left of an extension line L3 extending from a lift face 23*c* of the pawl 23*a* opposite a contact face thereof contacting the fixing roller 21. According to this exemplary embodiment, the extension line L3 extends substantially vertically in FIG. 8. The size or diameter of the pawl roller pair 40 is defined by a projection K of about 2 mm, that is, a gap between the extension line L3 and a tangential line L4 extending substantially vertically from an outer circumferential surface of the brushes 51 and 53 mounted on the pawl roller pair 40 in parallel with the extension line L3.

The greater projection K facilitates separation of the recording medium P from the pawl 23*a* even if the recording medium P is plain paper, thin paper having paper weight not greater than about 70 g/m$^2$, or soft paper, thus preventing the pawl 23*a* from producing scratches or glossy streaks on the toner image T on the recording medium P. By contrast, if the recording medium P is thick paper having paper weight not smaller than about 150 g/m$^2$ or hard paper, the greater projection K presses the pawl roller pair 40 against the recording medium P with greater pressure, thus causing the pawl roller pair 40 to produce scratches or glossy streaks on the toner image T on the recording medium P. To address this problem, based on a result of a simulation measuring scratches and glossy streaks produced by the separator 23 and the pawl roller pair 40, the projection K is set to about 2 mm.

The separator 23 includes a junction 23*d* situated at an intersection of the extension line L3 and the outer circumferential surface of the brushes 51 and 53 mounted on the pawl roller pair 40. Although the junction 23*d* is hatched in FIG. 8, the junction 23*d* may be molded with the pawl 23*a* or other part of the separator 23. For example, the junction 23*d* is substantially triangular in cross-section taken along a direction orthogonal to the axial direction of the fixing roller 21 with a first side 23*d*1 disposed opposite the outer circumferential surface of the brushes 51 and 53 mounted on the pawl roller pair 40 and a second side 23*d*2 contiguous to the lift face 23*c* of the pawl 23*a*. An extension line L2 extending from the second side 23*d*2 of the triangular junction 23*d* and the extension line L3 extending from the lift face 23*c* of the pawl 23*a* form an angle $\alpha$ of about 23 degrees. An extension line L1 extending from the first side 23*d*1 of the triangular junction 23*d*, that is, a tangential line on the outer circumferential surface of the brushes 51 and 53 of the pawl roller pair 40 at a right edge of the first side 23*d*1 of the triangular junction 23*d* in FIG. 8, and the extension line L2 form an angle $\beta$ of about 29 degrees. The angles $\alpha$ and $\beta$ may be determined based on results of a simulation to facilitate movement of the recording medium P over the pawl 23*a*, the junction 23*d*, and the pawl roller pair 40. It is to be noted that the angle $\alpha$ of about 23 degrees and the angle $\beta$ of about 29 degrees constitute one non-limiting exemplary embodiment.

The junction 23*d* disposed in proximity to the pawl 23*a* facilitates conveyance of the recording medium P from the pawl 23*a* to the pawl roller pair 40. Without the junction 23*d*, an angle formed by the extension lines L3 and L1, that is, the combined angle of the angles α and β is too great to prevent a leading edge of the recording medium P from striking the outer circumferential surface of the brushes 51 and 53 mounted on the pawl roller pair 40 substantially vertically, resulting in jamming of the recording medium P. Further, if each of the angles α and β is greater than about 30 degrees, as the recording medium P moves from the pawl 23*a* to the junction 23*d* and from the junction 23*d* to the pawl roller pair 40, the toner image T on the recording medium P may contact the pawl 23*a*, the junction 23*d*, and the pawl roller pair 40 with greater pressure, resulting in damage to the toner image T on the recording medium P and jamming of the recording medium P. To address these problems, each of the angles α and β is set to not greater than about 30 degrees.

Referring to FIGS. 5 and 7, a detailed description is now given of a construction of a guide roller pair 43.

As shown in FIG. 7, the guide roller pair 43 representing the guide roller pairs 43-1, 43-2, and 43-3 protruding from the fixing exit guide 41 depicted in FIG. 5 has an axis $O_{43}$ situated substantially directly above the axis $O_{40}$ of the pawl roller pair 40 in vertical cross-section in such a manner that a distance F from the exit of the fixing nip N to the axis $O_{43}$ of the guide roller pair 43 is about 20 mm. Conversely, in a horizontal front view illustrated in FIG. 5, the guide roller pairs 43-1, 43-2, and 43-3 and the pawl roller pairs 40-1, 40-2, 40-3, and 40-4 create the two staggered rows. As shown in FIG. 7, the diameter of the guide roller pair 43 is greater than the diameter of the pawl roller pair 40. A projection S, that is, a gap between a vertical tangential line L5 extending substantially vertically from the outer circumferential surface of the brushes 51 and 53 mounted on the pawl roller pair 40 and a vertical tangential line L6 extending substantially vertically from an outer circumferential surface of brushes 52 and 54 mounted on the guide roller pair 43 is about 2 mm.

The greater the projection S is, more effectively formation of a faulty toner image T on the recording medium P is prevented, such as scratches or glossy streaks produced on the toner image T on the recording medium P by the pawl 23*a* and the pawl roller pair 40 contacting the recording medium P. However, the greater projection S adheres moisture evaporated from the recording medium P to a projected portion of the guide roller pair 43 corresponding to the projection S that is situated above the fixing nip N. Specifically, as the fixing roller 21 and the pressing roller 22 apply heat and pressure to the recording medium P conveyed through the fixing nip N, moisture contained in the recording medium P is released into the atmosphere as steam after the recording medium P is discharged from the fixing nip N. As the steam moves upward and strikes a part of the outer circumferential surface of the guide roller pair 43 corresponding to the projection S, the steam adheres to an outer circumferential surface of the guide roller pair 43 as water droplets. Then, the water droplets are transferred from the guide roller pair 43 onto the recording medium P. As the recording medium P is discharged from the fixing device 20, the water droplets on the recording medium P are dried, leaving water droplet marks on the recording medium P. During duplex printing, a toner image T may not be transferred onto a back side of the recording medium P deteriorated by the water droplets adhered thereto, resulting in formation of a faulty toner image T on the recording medium P.

The shorter the distance F between the exit of the fixing nip N and the axis $O_{43}$ of the guide roller pair 43, the smaller the pressure between the recording medium P and the pawl 23*a* and the pawl roller pair 40, preventing formation of a faulty toner image Ton the recording medium P with scratches and glossy streaks on the toner image T produced by the pawl 23*a* and the pawl roller pair 40. Further, the shorter distance F decreases a horizontal interval between the pawl roller pair 40 and the recording medium P, decreasing the projection S. However, even with the decreased projection S, moisture evaporated from the recording medium P may adhere to the guide roller pair 43 as water droplets. As described above, since the guide roller pairs 43-1, 43-2, and 43-3 and the pawl roller pairs 40-1, 40-2, 40-3, and 40-4 create the two staggered rows, even with the shorter projection S, the guide roller pairs 43-1, 43-2, and 43-3 are exposed to moisture generated from the recording medium P heated at the fixing nip N. To address this circumstance, the fixing device 20 employs the brushes 51 to 54 described below.

Figure 9:
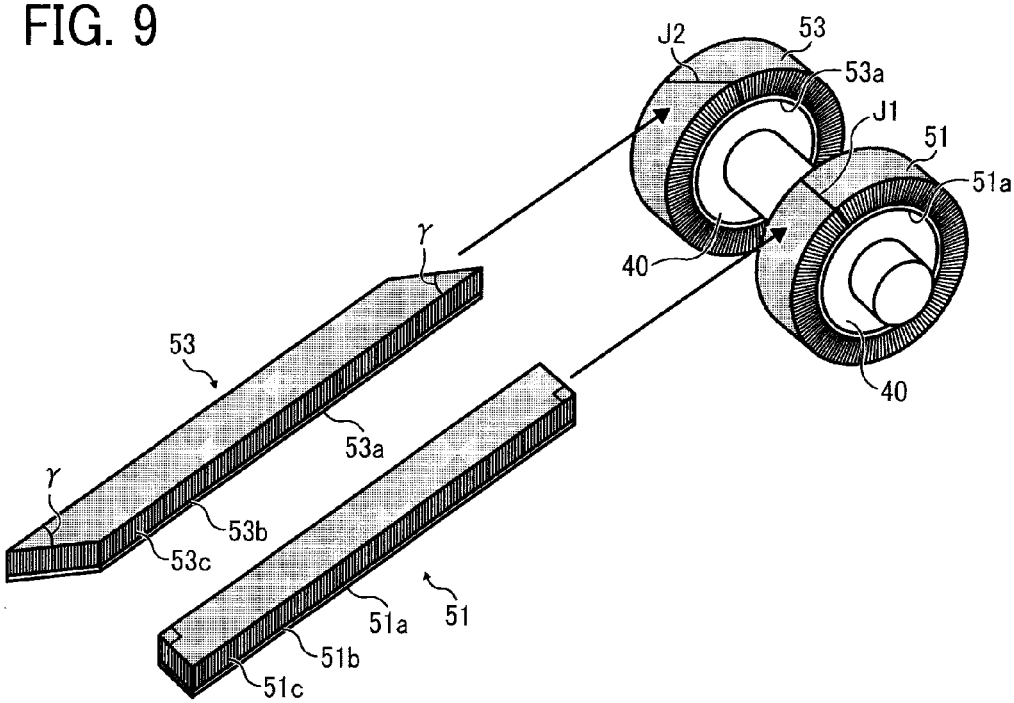
FIG. 9 is a perspective view of the pawl roller pair and brushes incorporated in the fixing device shown in FIG. 7.
Figure 10:
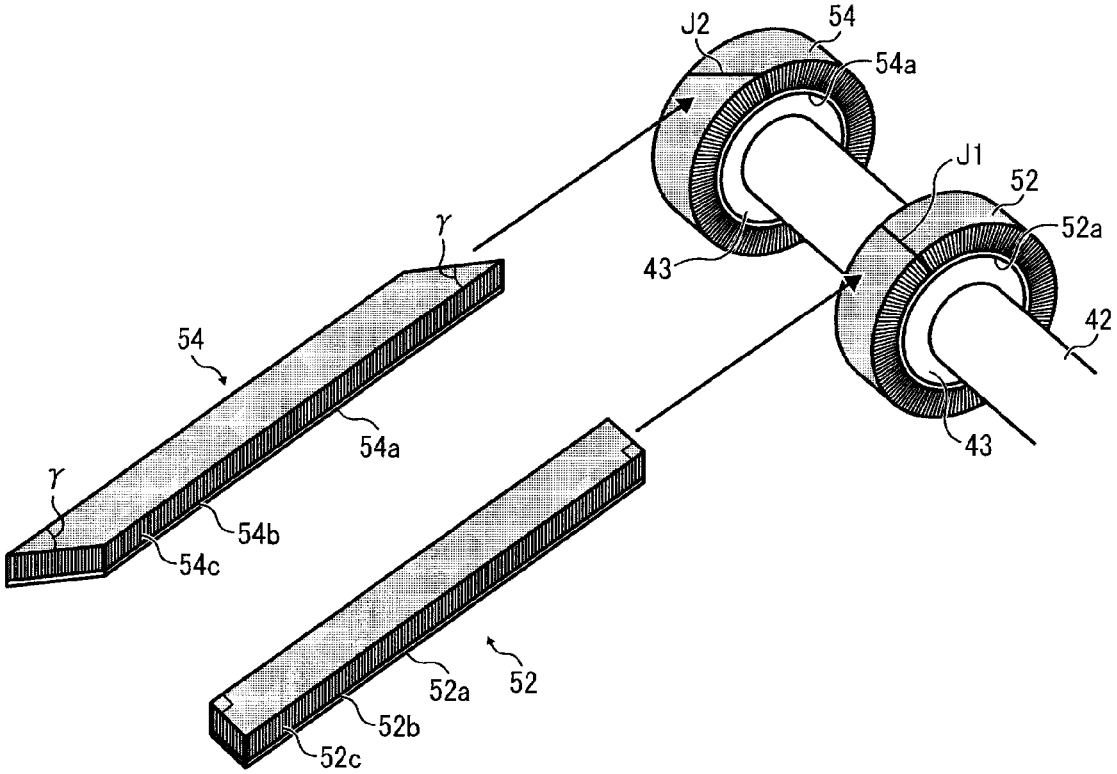
FIG. 10 is a perspective view of a guide roller pair and the brushes incorporated in the fixing device shown in FIG. 7.

Referring to FIGS. 9 to 10, a detailed description is now given of a construction of the brushes 51 to 54.

FIG. 9 is a perspective view of the pawl roller pair 40 and the brushes 51 and 53. FIG. 10 is a perspective view of the guide roller pair 43 and the brushes 52 and 54.

As shown in FIG. 9, two types of brushes, that is, the brushes 51 and 53, are mounted on an outer circumferential surface of the pawl roller pair 40. Similarly, as shown in FIG. 10, two types of brushes, that is, the brushes 52 and 54, are mounted on the outer circumferential surface of the guide roller pair 43. The brushes 51 and 52 are different from the brushes 53 and 54 in that the brushes 51 and 52 have straight cut ambilateral edges in a longitudinal direction thereof and the brushes 53 and 54 have diagonally cut ambilateral edges in a longitudinal direction thereof. Other than that, the brushes 51 to 54 have an identical structure. Since the diameter of the pawl roller pair 40 is smaller than that of the guide roller pair 43, the length of the brushes 51 and 53 in the longitudinal direction thereof is smaller than the length of the brushes 52 and 54 in the longitudinal direction thereof.

The brushes 51 to 54 are constructed of a heat-resistant fiber sheet made of nylon, aramid, polyurethane, or the like. According to this exemplary embodiment, a sheet implanted with fibers made of durable, heat-resistant nylon is cut into bands having lower adhesive faces 51*a* to 54*a*, respectively. For example, as shown in FIG. 9, the brush 51 is constructed of a base sheet 51*b* mounting fibers 51*c* at one face thereof and the adhesive face 51*a* at another face thereof. Similarly, the brush 53 is constructed of a base sheet 53*b* mounting fibers 53*c* and the adhesive face 53*a* as shown in FIG. 9; the brush 52 is constructed of a base sheet 52*b* mounting fibers 52*c* and the adhesive face 52*a* as shown in FIG. 10; and the brush 54 is constructed of a base sheet 54*b* mounting fibers 54*c* and the adhesive face 54*a* as shown in FIG. 10. The adhesive faces 51*a* and 53*a* are attached to the outer circumferential surface of the pawl roller pair 40 as shown in FIG. 9; the adhesive faces 52*a* and 54*a* are attached to the outer circumferential surface of the guide roller pair 43 as shown in FIG. 10. The fibers 51*c* to 54*c* have a length not smaller than about 0.8 mm, a density not smaller than about 10,000 pieces/$cm^2$, and a diameter not greater than about 1.5 denier, thus contacting the recording medium P more softly and thereby minimizing scratches and glossy streaks produced on the toner image T on the recording medium P compared to fibers not configured to have the length, the density, and the diameter of the above-described range. Even if moisture generated from the recording medium P adheres to the pawl roller pair 40 and the guide roller pair 43 as water droplets, the brushes 51 to 54 absorb the water droplets, minimizing water droplets transferred onto the toner image T on the recording medium P and resultant water droplet marks thereon. The water droplets absorbed by the brushes 51 to 54 are evaporated by the entirely heated fixing device 20, repeating absorption of the water droplets by the brushes 51 to 54.

Each of the brushes 51 to 54 is a band having a length in the longitudinal direction thereof wound around the entire outer circumferential surface of the respective pawl roller pair 40 and the guide roller pair 43 once. Each of the brushes 51 and 52 has square ambilateral ends in the longitudinal direction thereof. By contrast, each of the brushes 53 and 54 has triangular ambilateral ends in the longitudinal direction thereof that have an angle γ.

The square ambilateral ends of the brushes 51 and 52 are manufactured at reduced costs with decreased variation in part size. However, if the leading edge of the recording medium P strikes a seam J1 of the brushes 51 and 52, the seam J1 may damage, fold, or bend the recording medium P, thus jamming the recording medium P. Further, after the recording medium P strikes the seam J1 of the brushes 51 and 52 repeatedly, it may gradually degrade an adhesive force of the adhesive faces 51*a* and 52*a* of the brushes 51 and 52, and finally peel the brushes 51 and 52 off the pawl roller pair 40 and the guide roller pair 43.

By contrast, the triangular ambilateral ends of the brushes 53 and 54 with the angle γ allow the leading edge of the recording medium P to strike a seam J2 of the brushes 53 and 54 gradually, minimizing damage to the recording medium P and thereby improving durability of the brushes 53 and 54 compared to the square ambilateral ends of the brushes 51 and 52 having the seam J1. For example, the angle γ may be in a range of from about 30 degrees to about 60 degrees with respect to the recording medium conveyance direction D1. The angle γ smaller than about 30 degrees narrows a head of the triangular ambilateral ends of the brushes 53 and 54, peeling the brushes 53 and 54 off the pawl roller pair 40 and the guide roller pair 43 easily. Conversely, the angle γ greater than about 60 degrees may raise the problems of the seam J1 of the square ambilateral ends of the brushes 51 and 52 described above.

Figure 11:
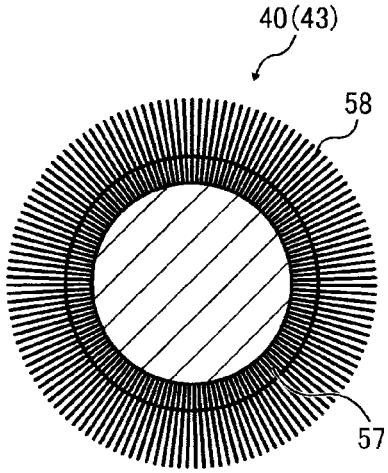
FIG. 11 is a vertical sectional view of the pawl roller pair and the guide roller pair incorporated in the fixing device shown in FIG. 7 that are electrostatically implanted with fibers.

Referring to FIG. 11, the following describes a configuration of electrostatic implantation of fibers on the pawl roller pair 40 and the guide roller pair 43.

FIG. 11 is a vertical sectional view of the pawl roller pair 40 and the guide roller pair 43 electrostatically implanted with fibers. As shown in FIG. 11, an adhesive 57 is applied to an outer circumferential surface of the base, made of PBT or the like, of the pawl roller pair 40 and the guide roller pair 43. Then, lots of fibers 58 serving as a brush are implanted to the adhesive 57 and the base of the pawl roller pair 40 and the guide roller pair 43 is electrostatically charged. For example, the fibers 58 are nylon fibers having a length not smaller than about 0.8 mm, a density not smaller than about 10,000 pieces/$cm^2$, and a diameter not greater than about 1.5 denier. As the base of the pawl roller pair 40 and the guide roller pair 43 is electrostatically charged in a state in which the fibers 58 are implanted to the adhesive 57, electrostatic repulsion causes the fibers 58 to stand upright on the outer circumferential surface of the base of the pawl roller pair 40 and the guide roller pair 43 until the adhesive 57 is solidified. Since every fiber 58 is adhered to the pawl roller pair 40 and the guide roller pair 43 with the adhesive 57, there are no seams J1 and J2 of the brushes 51 to 54 depicted in FIGS. 9 and 10 that may peel the fibers 58 off the pawl roller pair 40 and the guide roller pair 43. Additionally, the fibers 58 adhered to the pawl roller pair 40 and the guide roller pair 43 attain improved durability compared to the brushes 53 and 54 having the triangular ambilateral ends.

Further, since the sheet brushes 51 to 54 have variation in size and error in adhesion to the pawl roller pair 40 and the guide roller pair 43, it is difficult to adhere the brushes 51 to 54 to the entire outer circumferential surface of the pawl roller pair 40 and the guide roller pair 43. To address this circumstance, it is necessary to adhere the brushes 51 to 54 to the reduced outer circumferential surface of the pawl roller pair 40 and the guide roller pair 43 in view of variation in size and error in adhesion to the pawl roller pair 40 and the guide roller pair 43. Conversely, the fibers 58 are adhered to the entire outer circumferential surface of the pawl roller pair 40 and the guide roller pair 43 under electrostatic implantation, increasing the contact area where the fibers 58 contact the recording medium P compared to the sheet brushes 51 to 54 adhered to the pawl roller pair 40 and the guide roller pair 43 of the identical size. Accordingly, the fibers 58 contact the recording medium P more softly, minimizing scratches and glossy streaks produced on the toner image T on the recording medium P more precisely.

Figure 12:
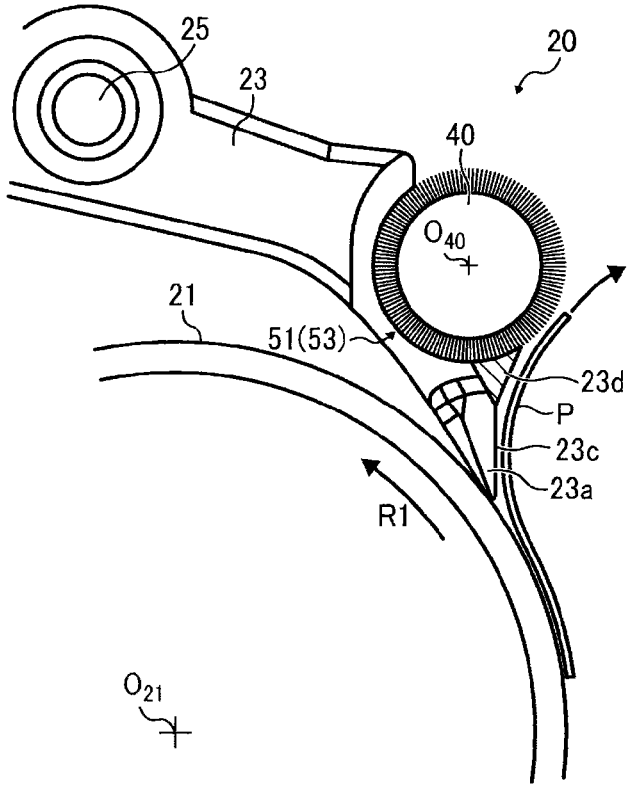
FIG. 12 is a vertical sectional view of the separator, the pawl roller pair, and the fixing roller shown in FIG. 8 illustrating movement of a recording medium conveyed thereover.
Figure 13:
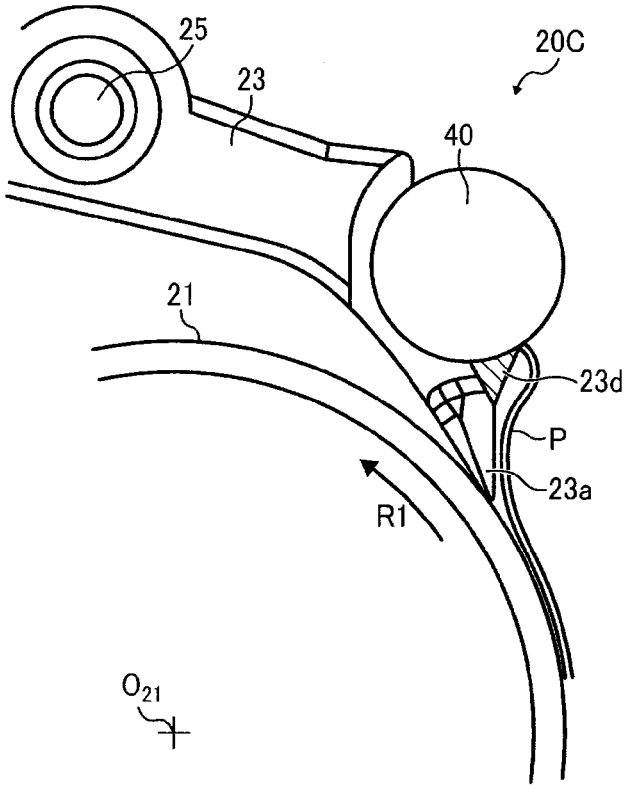
FIG. 13 is a partial vertical sectional view of a comparative fixing device illustrating movement of a recording medium conveyed therethrough.

Referring to FIGS. 12 and 13, the following describes an operation of the pawl 23*a* of the separator 23, the pawl roller pair 40, and the guide roller pair 43.

A detailed description is now given of an operation of the pawl 23*a* of the separator 23.

FIG. 12 is a vertical sectional view of the fixing device 20 illustrating movement of the recording medium P. As shown in FIG. 12, as the pawl 23*a* contacts the fixing roller 21, even if the recording medium P discharged from the fixing nip N still adheres to the fixing roller 21, the pawl 23*a* separates the recording medium P from the fixing roller 21. For example, when the leading edge of the recording medium P mounts the lift face 23*c* of the pawl 23*a*, the recording medium P slides over the lift face 23*c* of the pawl 23*a* toward the outer circumference surface of the pawl roller pair 40. Immediately before the leading edge of the recording medium P mounts the pawl roller pair 40, it moves from the lift face 23*c* of the pawl 23*a* to the junction 23*d* that forms the angle α depicted in FIG. 8 with the lift face 23*c* of the pawl 23*a*. Since the angle α is smaller than about 30 degrees, for example, about 23 degrees, the lift face 23*c* of the pawl 23*a* and the junction 23*d* press against the recording medium P with moderate pressure. Accordingly, even if the recording medium P stores heat and therefore bears the soft toner image T softened by the heat, the lift face 23*c* of the pawl 23*a* and the junction 23*d* do not produce scratches and glossy streaks on the soft toner image T on the recording medium P.

As the leading edge of the recording medium P mounts the pawl roller pair 40 from the junction 23*d*, it comes into contact with the brushes 51 and 53 mounted on the outer circumferential surface of the pawl roller pair 40 softly, thus rotating the pawl roller pair 40. Simultaneously, the recording medium P moves upward while it is supported by a head of lots of fibers constituting the outer circumferential surface of the brushes 51 and 53. Since the angle β depicted in FIG. 8 is smaller than about 30 degrees, for example, about 29 degrees, the junction 23*d* and the pawl roller pair 40 press against the recording medium P with moderate pressure. Accordingly, even if the recording medium P stores heat and therefore bears the soft toner image T softened by the heat, the junction 23*d* and the pawl roller pair 40 do not produce scratches and glossy streaks on the soft toner image T on the recording medium P.

Moisture evaporated from the recording medium P by heat and pressure applied at the fixing nip N moves upward along the recording medium conveyance direction D1 in accordance with movement of the recording medium P. When the moisture comes into contact with the separator 23, it is cooled by the separator 23 into water droplets. However, the brushes 51 and 53 mounted on the outer circumferential surface of the pawl roller pair 40 absorb the water droplets, preventing adhesion of the water droplets to the recording medium P and resultant water droplet marks on the recording medium P that may damage the toner image T during duplex printing.

Referring to FIG. 13, a detailed description is now given of a configuration of a comparative fixing device 20C without the brushes 51 and 53.

FIG. 13 is a vertical sectional view of the comparative fixing device 20C illustrating movement of the recording medium P. As shown in FIG. 13, the comparative fixing device 20C does not include the brushes 51 and 53 depicted in FIG. 12 and therefore the pawl roller pair 40 exposes its PFA tube. Since the outer circumferential surface of the pawl roller pair 40 is harder than the brushes 51 and 53, the leading edge of the recording medium P strikes the outer circumferential surface of the pawl roller pair 40 with a greater impact. As the greater impact bends the leading edge of the recording medium P, the bent leading edge of the recording medium P may trigger jamming of the recording medium P. Further, as the toner image T on the recording medium P comes into contact with the outer circumferential surface of the pawl roller pair 40, the pawl roller pair 40 may produce scratches and glossy streaks on the toner image T on the recording medium P. Moreover, as moisture evaporated from the recording medium P adheres to the outer circumferential surface of the pawl roller pair 40 as water droplets, the water droplets may be transferred to the toner image T on the recording medium P, producing water droplet marks on the toner image T on the recording medium P. Thus, the pawl roller pair 40 without the brushes 51 and 53 may raise failures that may degrade the quality of the toner image T formed on the recording medium P.

As shown in FIG. 7, after the leading edge of the recording medium P passes over the pawl roller pair 40, it moves upward to the guide roller pair 43 located above the pawl roller pair 40. While the recording medium P moves upward to the guide roller pair 43, the recording medium P is cooled by the atmosphere and the toner image T on the recording medium P is solidified. The axis $O_{43}$ of the guide roller pair 43 is situated at the distance F from the exit of the fixing nip N, which is determined in view of cooling of the recording medium P while the recording medium P is conveyed from the exit of the fixing nip N to the guide roller pair 43. As the leading edge of the recording medium P mounts the guide roller pair 43, it comes into contact with the brushes 52 and 54 mounted on the outer circumferential surface of the guide roller pair 43 softly, thus rotating the guide roller pair 43. Simultaneously, the recording medium P moves upward further in a state in which it is supported by the head of lots of fibers constituting the outer circumferential surface of the brushes 52 and 54.

The angle at which the leading edge of the recording medium P contacts the outer circumferential surface of the guide roller pair 43 is changed according to the projection S of the guide roller pair 43. However, since the projection S is set to about 2 mm according to this exemplary embodiment, the leading edge of the recording medium P contacts the guide roller pair 43 at a moderate angle. Thus, the protrusion S of the guide roller pair 43, cooling of the recording medium P, the angle at which the recording medium P contacts the guide roller pair 43, and the advantages of the brushes 52 and 54 mounted on the guide roller pair 43 prevent production of scratches and glossy streaks on the toner image T on the recording medium P and formation of water droplet marks on the toner image T on the recording medium P.

By the time the recording medium P reaches the guide roller pair 43, the toner image T on the recording medium P may have already been cooled and solidified. Further, addition of the pawl roller pair 40 mounting the brushes 51 and 53 may attain moisture proof sufficiently. In this case, even if the recording medium P contacts the guide roller pair 43, the guide roller pair 43 neither produces scratches and glossy streaks on the toner image T on the recording medium P nor creates water droplet marks on the recording medium P. Accordingly, the pawl roller pair 40 may mount the brushes 51 and 53 but the guide roller pair 43 may not mount the brushes 52 and 54 at all or at least one guide roller pair 43 may mount the brushes 52 and 54.

As shown in FIG. 7, the recording medium P is guided by the pawl 23*a* of the separator 23, the junction 23*d*, the pawl roller pair 40, and the guide roller pair 43 in this order in the recording medium conveyance direction D1. When a trailing edge of the recording medium P is discharged from the fixing nip N and passes over the pawl 23*a* of the separator 23, the pawl 23*a* separates from the fixing roller 21 as shown in FIG. 2. For example, after the tailing edge of the recording medium P passes through the fixing nip N, the controller 37 interrupts electric current supply to the solenoid 30 and therefore the plunger 32 no longer retracts into the body 31. Accordingly, the separator presser 27 presses down the base 23*b* of the separator 23 by a resilient bias exerted by the separation direction biasing member 29 that generates the rotation moment M3. Consequently, the separator 23 rotates counterclockwise in FIG. 2 by the rotation moment M2.

As described above, the rotation moment M2 exerted by the separation direction biasing member 29 to the separator 23 to rotate the separator 23 counterclockwise in FIG. 2 is greater than the rotation moment M1 exerted by the contact direction biasing member 26 to the separator 23 to rotate the separator 23 clockwise in FIG. 2. Accordingly, the separator 23 rotates counterclockwise in FIG. 2 and therefore the pawl 23*a* separates from the fixing roller 21. Whenever the recording medium P is conveyed through the fixing nip N, the separator 23 is brought into contact with and separated from the fixing roller 21.

Referring to FIG. 14, the following describes results of an experiment to verify advantages attained by the exemplary embodiments described above.

The experiment verifies three advantages, that is, elimination of scratches and glossy streaks; elimination of water droplet marks; and improvement in durability, for the brushes 51 to 54 shown in FIGS. 9 and 10, the fibers 58 shown in FIG. 11, and the pawl roller pair 40 without fibers shown in FIG. 13. FIG. 14 is a lookup table showing the results of the experiment. In the table, "with fibers" denotes electric fibers such as the fibers 58 depicted in FIG. 11 and a sheet brush such as the brushes 51 to 54 depicted in FIGS. 9 and 10; "without fibers" denotes the PFA roller pair constructed of the base coated with the fluoroplastic (e.g., PFA) tube, such as the pawl roller pair 40 of the comparative fixing device 20C shown in FIG. 13. The elimination of scratches and glossy streaks is ranked on a scale of 1 to 5 where rank 5 defines the best and rank 1 defines the worst.

Rank 5 defines a state in which no scratches and glossy streaks are identified on the toner image T on the recording medium P. Rank 4 defines a state in which no scratches and glossy streaks are identified on the toner image T on the recording medium P when viewed from the front but some scratches and glossy streaks are identified when viewed from an angle other than the front. Rank 3 defines a state in which slight scratches and glossy streaks are identified on the toner image T on the recording medium P when viewed from the front. Rank 2 defines a state in which scratches and glossy streaks are identified clearly on the toner image T on the recording medium P when viewed from the front. Rank 1 defines a state in which scratches and glossy streaks are identified clearly on the toner image T on the recording medium P when viewed from any angle, the toner image T is chipped in parts, and white streaks appear on the toner image T.

The elimination of water droplet marks is ranked on a scale of "good", "fair", and "poor". "Good" defines a state in which no water droplet marks are identified on the toner image T on the recording medium P. "Fair" defines a state in which water droplet marks are identified slightly on the toner image T on the recording medium P under a limited condition, such as on initial several recording media P. "Poor" defines a state in which water droplet marks are identified frequently on the toner image Ton the recording medium P.

The improvement in durability is ranked on a scale of "good", "fair", and "poor". "Good" defines superior durability. "Fair" defines inferior durability compared to "good" and decreased durability under some condition. "Poor" defines poor durability.

As shown in FIG. 14, the PFA roller pair without fibers is ranked as 3 for elimination of scratches and glossy streaks and "fair" for elimination of water droplet marks. By contrast, electrostatic fibers and sheet brush with fibers are ranked as 4 for elimination of scratches and glossy streaks and "good" for elimination of water droplet marks. Especially, electrostatic fibers also attain "good" for improvement in durability.

Referring to FIG. 7, the following describes advantages of the fixing device 20 according to the exemplary embodiments described above.

As shown in FIG. 7, the fixing device 20 includes the fixing roller 21 serving as a fixing rotary body rotatable in the rotation direction R1; the pressing roller 22 serving as a pressing rotary body rotatable in the rotation direction R2 counter to the rotation direction R1 of the fixing roller 21 and contacting the fixing roller 21 to form the fixing nip N therebetween through which a recording medium P bearing a toner image T is conveyed; the heater 24 to heat at least one of the fixing roller 21 and the pressing roller 22; and the plurality of separators 23 aligned in the axial direction of the fixing roller 21 and separatably contacting the fixing roller 21. Each separator 23 includes the pawl 23*a* to separatably contact the fixing roller 21 to separate the recording medium P discharged from the fixing nip N from the fixing roller 21. The fixing device 20 further includes the plurality of pawl roller pairs 40 serving as a first rotary body. Each pawl roller pair 40 is rotatably supported by each separator 23 and contacts and guides the recording medium P separated from the fixing roller 21 by the pawl 23*a* in the recording medium conveyance direction D1. The fixing device 20 further includes the fixing exit guide 41 to guide the recording medium P passing over the pawl roller pair 40 in the recording medium conveyance direction D1; the guide roller pair 43 serving as a second rotary body rotatably supported by the fixing exit guide 41 and guiding the recording medium P in the recording medium conveyance direction D1; and at least one of the brushes 51 to 54 and the fibers 58, depicted in FIG. 11, serving as a brush mounted on the outer circumferential surface of the pawl roller pair 40 and the guide roller pair 43.

The recording medium P discharged from the fixing nip N moves over the pawl 23*a* of the separators 23, the pawl roller pair 40, and the guide roller pair 43 in this order in the recording medium conveyance direction D1, distributing pressure exerted by the recording medium P among the pawl 23*a*, the pawl roller pair 40, and the guide roller pair 43. Additionally, even if the recording medium P bears the soft toner image T softened by heat from the fixing roller 21 as it is conveyed through the fixing nip N, the brushes 51 and 53 mounted on the pawl roller pair 40 absorb impact given to the recording medium P as the recording medium P comes into contact with the pawl roller pair 40, thus preventing scratches and glossy streaks produced on the toner image T on the recording medium P by the pawl roller pair 40. When the recording medium P reaches the guide roller pair 43, the toner image T has been cooled and solidified, preventing formation of a faulty toner image T such as scratches and glossy streaks produced on the toner image T on the recording medium P due to contact with the guide roller pair 43. If the guide roller pair 43 also mounts the brushes 52 and 54 similarly to the pawl roller pair 40 mounting the brushes 51 and 53, the brushes 52 and 54 prevent scratches and glossy streaks produced on the toner image T on the recording medium P more precisely.

The moisture-proof brushes 51 to 54 absorb moisture evaporated from the recording medium P by heat and pressure applied to the recording medium P at the fixing nip N. Accordingly, moisture evaporated from the recording medium P does not adhere to an interior wall of a conveyance path through which the recording medium P passes and does not accumulate on the interior wall of the conveyance path as water droplets that may be transferred onto the recording medium P and left on the recording medium P as water droplet marks.

The present invention is not limited to the details of the exemplary embodiments described above, and various modifications and improvements are possible. For example, according to the exemplary embodiments described above, the fixing roller 21 serves as a fixing rotary body. Alternatively, the fixing rotary body may be an endless belt, an endless film, or the like. Further, according to the exemplary embodiments described above, the pressing roller 22 serves as a pressing rotary body. Alternatively, the pressing rotary body may be an endless belt, a pad, a plate, or the like.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

a pressing rotary body rotatably contacting the fixing rotary body to form a fixing nip therebetween through which a recording medium bearing a toner image is conveyed;

a heater disposed opposite at least one of the fixing rotary body and the pressing rotary body to heat the at least one of the fixing rotary body and the pressing rotary body;

at least one separator separatably contacting an outer circumferential surface of the fixing rotary body and including a pawl to contact and separate the recording medium discharged from the fixing nip from the fixing rotary body;

at least one first rotary body rotatably supported by the at least one separator to contact and guide the recording medium separated by the pawl of the at least one separator in a recording medium conveyance direction;

at least one second rotary body disposed downstream from the first rotary body in the recording medium conveyance direction to contact and guide the recording medium guided by the first rotary body in the recording medium conveyance direction; and at least one brush mounted on an outer circumferential surface of at least one of the first rotary body and the second rotary body.

2. The fixing device according to claim 1, wherein the first rotary body includes a first pair of rollers and the at least one brush is mounted on an outer circumferential surface of at least one roller of the first pair of rollers.

3. The fixing device according to claim 1, wherein the second rotary body includes a second pair of rollers and the at least one brush is mounted on an outer circumferential surface of at least one roller of the second pair of rollers.

4. The fixing device according to claim 1, further comprising a fixing exit guide rotatably supporting the second rotary body.

5. The fixing device according to claim 1, wherein the brush includes:

a base sheet;

an adhesive face constituting a first outer face of the base sheet adhered to the outer circumferential surface of the at least one of the first rotary body and the second rotary body; and fibers mounted on a second outer face of the base sheet opposite the first outer face.

6. The fixing device according to claim 5, wherein the brush is wound around the outer circumferential surface of the at least one of the first rotary body and the second rotary body, and wherein the brush includes square ambilateral ends in a circumferential direction of the brush.

7. The fixing device according to claim 5, wherein the brush is wound around the outer circumferential surface of the at least one of the first rotary body and the second rotary body, and wherein the brush includes triangular ambilateral ends in a circumferential direction of the brush.

8. The fixing device according to claim 7, wherein each of the triangular ambilateral ends of the brush has an angle in a range of from about 30 degrees to about 60 degrees with respect to a circumferential edge of the base sheet of the brush.

9. The fixing device according to claim 1, wherein the brush includes fibers electrostatically implanted on the outer circumferential surface of the at least one of the first rotary body and the second rotary body with an adhesive.

10. The fixing device according to claim 1, wherein the pawl of the separator includes a lift face to contact the recording medium discharged from the fixing nip, and wherein the first rotary body has a first projection of about 2 mm projecting from a first extension line extending substantially vertically from the lift face of the pawl to a first tangential line extending from an outer circumferential surface of the brush mounted on the first rotary body in parallel with the first extension line.

11. The fixing device according to claim 1, wherein the second rotary body has a second projection of about 2 mm projecting from a second tangential line extending substantially vertically from an outer circumferential surface of the brush mounted on the first rotary body to a third tangential line extending substantially vertically from an outer circumferential surface of the brush mounted on the second rotary body.

12. The fixing device according to claim 10, wherein the separator further includes a junction interposed between the pawl and the first rotary body in the recording medium conveyance direction to contact and guide the recording medium from the pawl to the first rotary body.

13. The fixing device according to claim 12, wherein the junction of the separator is substantially triangular in cross-section taken along a direction orthogonal to an axial direction of the first rotary body with a first side disposed opposite the outer circumferential surface of the first rotary body and a second side contiguous to the lift face of the pawl.

14. The fixing device according to claim 13, wherein a second extension line extending from the second side of the triangular junction and the first extension line extending from the lift face of the pawl form an angle $\alpha$ smaller than about 30 degrees, and wherein a third extension line extending from the first side of the triangular junction and the second extension line form an angle 13 smaller than about 30 degrees.

15. The fixing device according to claim 1, wherein the brush includes fibers having a length not smaller than about 0.8 mm.

16. The fixing device according to claim 1, wherein the brush includes fibers having a density not smaller than about 10,000 pieces/$cm^2$.

17. The fixing device according to claim 1, wherein the brush includes fibers having a diameter not greater than about 1.5 denier.

18. The fixing device according to claim 1, wherein the brush includes fibers made of nylon.

19. The fixing device according to claim 1, wherein the fixing rotary body includes a fixing roller and the pressing rotary body includes a pressing roller.

20. An image forming apparatus comprising the fixing device according to claim 1.

* * * * *